US007607324B2

(12) United States Patent
Lonati

(10) Patent No.: US 7,607,324 B2
(45) Date of Patent: Oct. 27, 2009

(54) JACQUARD DEVICE TO SELECTIVELY SHIFT THREAD GUIDES IN A TEXTILE MACHINE

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/256,077

(22) Filed: Oct. 22, 2008

(65) Prior Publication Data

US 2009/0107184 A1 Apr. 30, 2009

(30) Foreign Application Priority Data

Oct. 24, 2007 (IT) ..... BS2007A0164

(51) Int. Cl.
*D04B 27/26* (2006.01)

(52) U.S. Cl. ..... 66/205

(58) Field of Classification Search ..... 66/204, 66/205, 207

See application file for complete search history.

(56) References Cited

U.S. PATENT DOCUMENTS 3,834,193 A 9/1974 Wilkens
4,051,698 A * 10/1977 Leonhardt ..... 66/205
4,570,462 A 2/1986 Roth
4,702,286 A 10/1987 Palau et al.
5,561,989 A 10/1996 Mista
5,675,993 A * 10/1997 Ono et al. ..... 66/204

FOREIGN PATENT DOCUMENTS

JP 63092762 4/1988

* cited by examiner

*Primary Examiner*—Danny Worrell
(74) *Attorney, Agent, or Firm*—Pearne & Gordon LLP

(57) ABSTRACT

A jacquard device (1) for selectively shifting thread-guides (2) in a knitting machine, comprising at least one supporting element (3) provided with a plurality of housing seats (4) for a plurality of thread-guides (2), a plurality of thread-guides (2) mounted onto the supporting element (3) and having at least one thread-guide portion (2*b*) selectively moving at least between a first and a second operating position and apt to guide a thread (7), at least one actuating element (12) for each thread-guide (2) for shifting the thread-guide portions (2*b*) of the thread-guides (2) between the first operating position and the second operating position, and at least one electropneumatic actuating device (15) operatively connected to the actuating element (12) for shifting the thread-guide portion (2*b*) of the thread-guides (2).

27 Claims, 15 Drawing Sheets

FIG. 2b
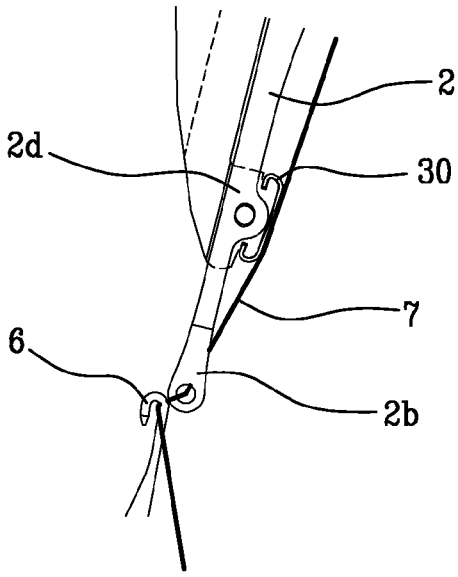
FIG. 2c
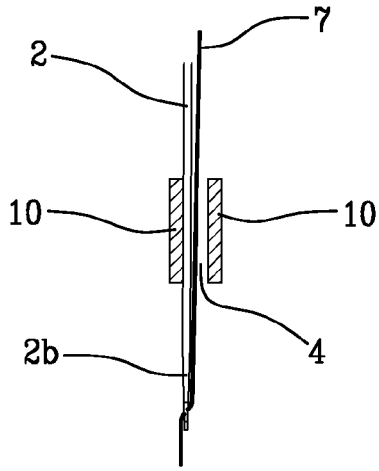
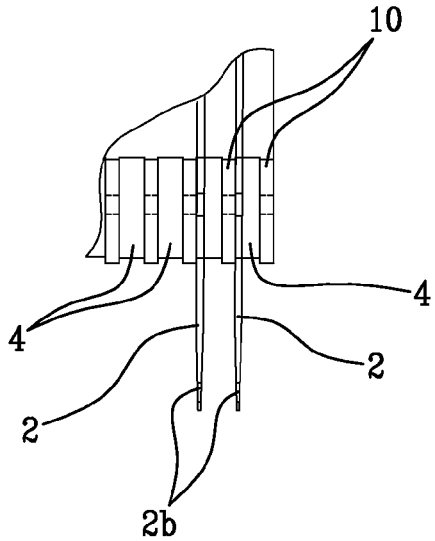
FIG. 2d
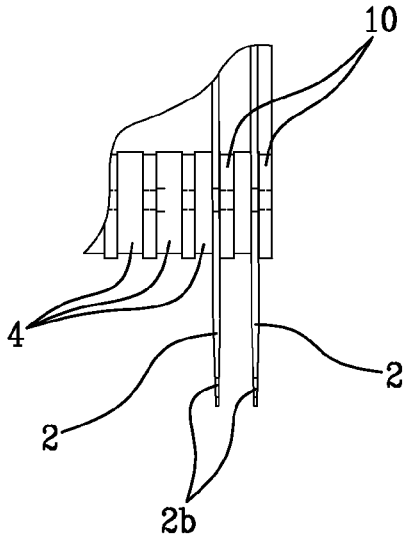
FIG. 2e

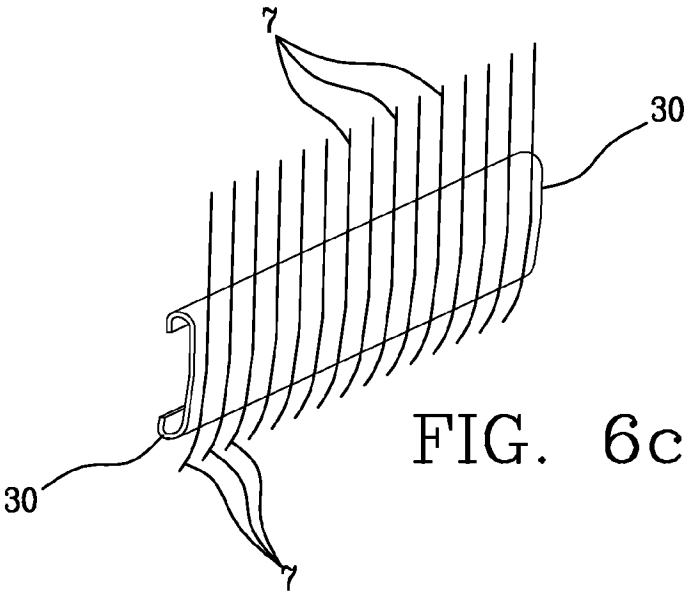
FIG. 6c
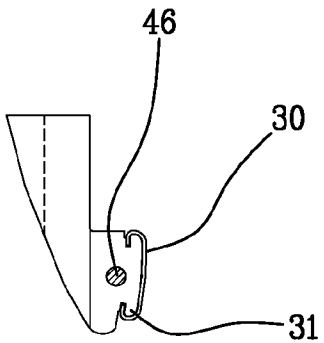
FIG. 6b
FIG. 6
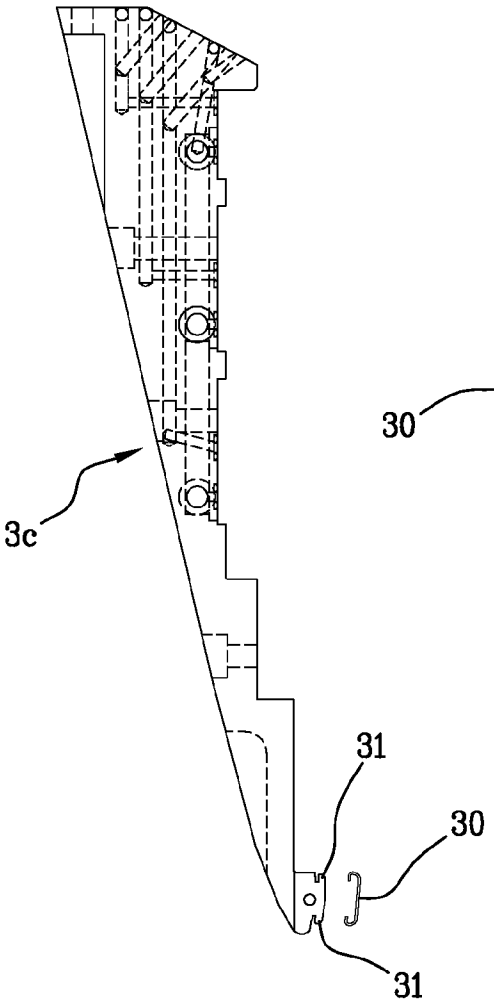
FIG. 6a
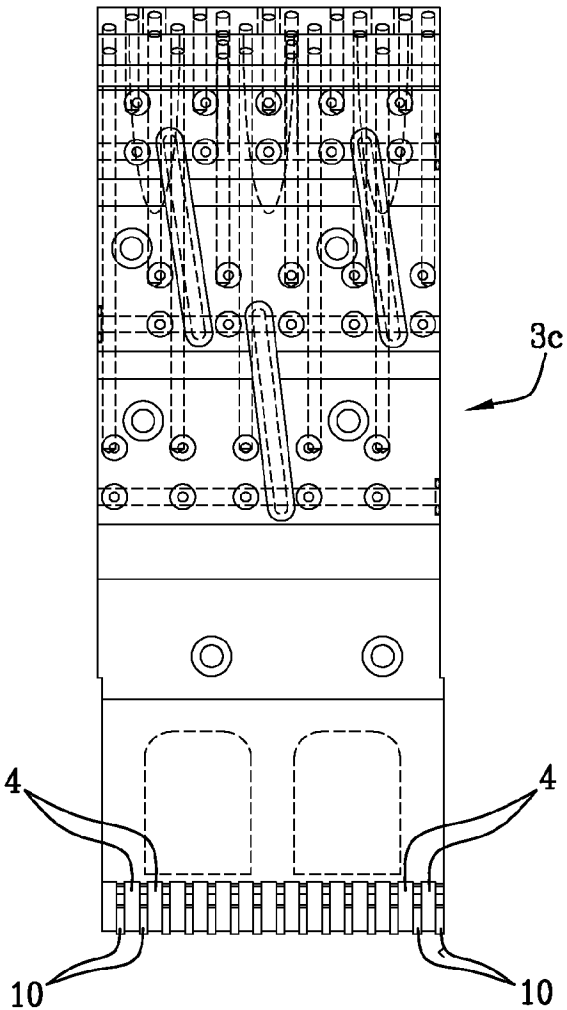

FIG. 15
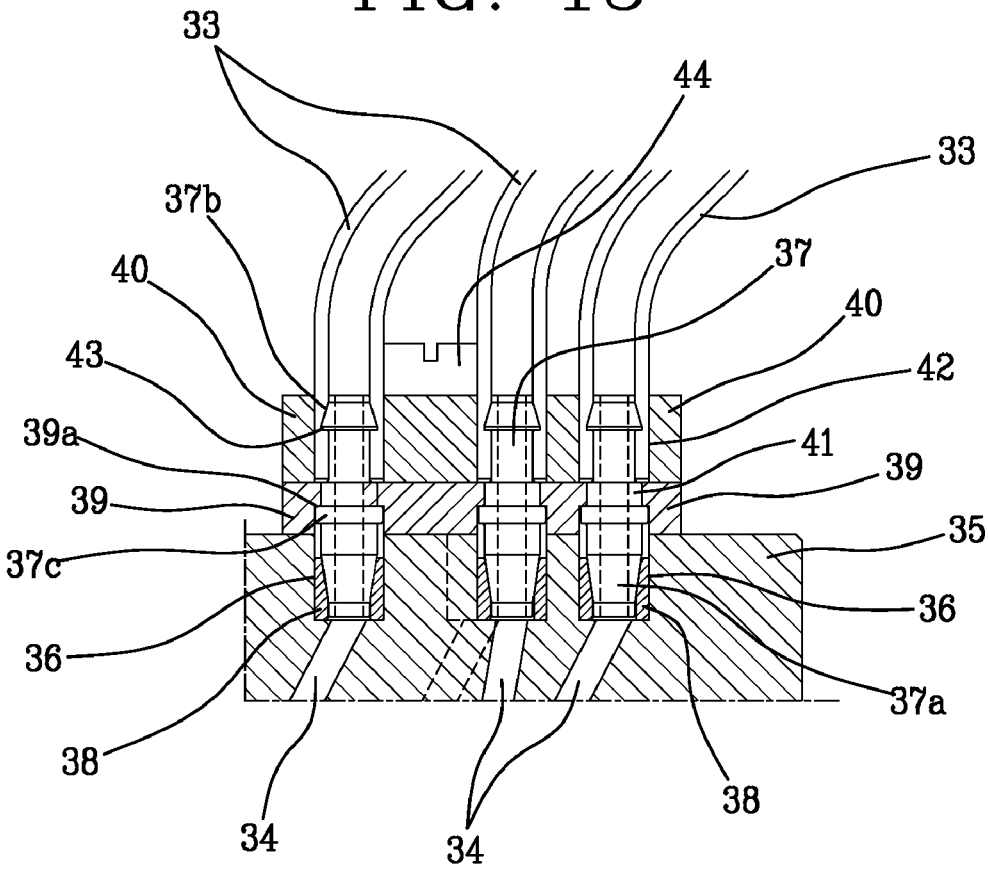
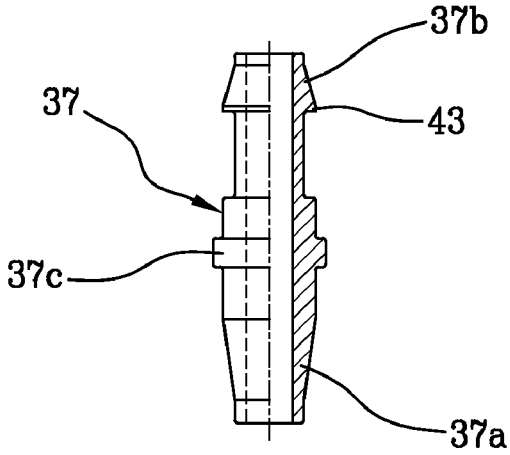
FIG. 15a
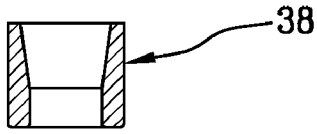
FIG. 15b

JACQUARD DEVICE TO SELECTIVELY SHIFT THREAD GUIDES IN A TEXTILE MACHINE

The present invention relates to a jacquard device for selectively shifting thread-guides in a knitting machine, in particular for linear knitting machines such as warp looms, e.g. of Raschel type and similar, for obtaining variously knitted fabrics such as jacquard fabrics and the like.

As is known, modern jacquard looms are provided with and characterized by devices apt to selectively shift thread-guides according to the pattern to be obtained in the fabric.

To this purpose two technologies are basically used today: one making use of piezoelectric or piezoceramic elements, the other one using an older system, though as effective as the first, for pulling and pushing shifting elements that are able to deflect thread-guides in their lower end. In this area the guide hole of the thread-guide, which the knitting thread gets through, shall interact with the underlying needle according to known technique. Selectively shifting thread-guides means shifting them singularly of a space between two adjacent needles, so that during weaving the thread designed for a needle by the movement of the thread-guide bar can be selectively shifted onto the adjacent needle (i.e. forward or backward of one step with respect to the designed position), so as to obtain the desired textile effect. As far as the technique involving thread-guide shift by means of piezoelectric actuators is concerned, reference can be made for instance to Patent no. JP63092762 of Sep. 30, 1986, wherein the selective action is obtained by way of suitably polarized electric current, which is able to deflect a thread-holding plate or thread-guide to the desired position.

The other technique, also known as "pull-and-push" of shifting elements, makes use of a jacquard mechanical head, to which metal wires or cords are connected, typically with vertical actuation, suitably hooked to corresponding control elements. The pulling action is carried out by the wire (pulling upward), the pushing action by a spring (pushing downward) of the shifting element of the thread-guide itself.

Typical examples of this technology are the jacquard loom described in Patent U.S. Pat. No. 4,570,462 of Feb. 18, 1986 and the one described in Patent U.S. Pat. No. 3,834,193 of Sep. 10, 1974.

These systems, widely used in Raschel jacquard machines, have drawbacks limiting their application, and therefore their use depends on the type of knitted product to be obtained.

Piezoelectric systems are mainly suitable for use on looms having quite a high needle thickness or fineness. The term "fineness" refers to the number of needles, and thus of thread-guides, that are present in one inch, i.e. 25.4 mm. For instance, fineness=24 means that in 1" (one inch), i.e. 25.4 mm, there are 24 needles. The space between one needle and the other is therefore 25.4:24=1.0583333333 mm.

Needles having such fineness have a hook with a thickness of 0.25 to 0.35 mm and thread-guides that have to get through between one needle and the other safely have approximately the same thickness.

The shift of the lower portion of the guide holding the thread, in case of fineness 24, is of 1.0583 mm, since said guide can shift in a space between two stopping wings or mechanical abutments, and depending on whether it is shifted to the left or to the right, it abuts with its left or right face.

These small shifts are carried out relatively fast with respect to the theoretical potentialities of the piezoelectric element. The piezoelectric actuator in se is very fast in bending for causing the shift of the lower portion of the thread-guide to which it is connected. However, its drawback consists in that it has force for keeping the achieved position not above 20-30 grams, depending on the ceramic elements used and on voltages and currents applied.

Suitable, sophisticated techniques for piloting such actuators (electronic dosage of voltage and current in the lapse of time used for control actuation) attenuate the phenomenon by which the thread-guide "bounces" on the abutting wing, therefore only when the thread-guide has reached a stable position, the shog operation can be carried out, i.e. horizontal shift of the needle bar.

This "bouncing" phenomenon prevents a possible increase in loom operating speed, canceling the higher actuation possibilities that are typical of piezoelectric transducers.

Moreover, the knitting thread is threaded into the thread-guide, which thread is in se tightened with a force of about 10 grams and more in vertical direction and it is wound or taken by the needle under speed during weaving.

In the various knitting moments or knitting steps, the thread threaded into the thread-guide is subject to various forces tending to keep the latter in different positions or to let it take such positions. The action of the needle on the thread threaded into the yarn is very fast and resembles a pull.

These forces have to be overcome by the bending action of the piezoelectric element under the action of voltage and current used for the control thereof. Therefore, as a result of the low force that can be applied by piezoelectric elements, it is necessary to optimize the use of such force by distributing it adequately, at right times and in case of particularly unfavorable conditions, the times for carrying out the movement must necessarily be lengthened, on pain of an inaccurate knitting, which causes production rejects or worse collisions between thread-guides and needles, damaging both, followed by knitting defects and the need to replace involved parts.

Reference has been made to quite high finenesses, since in these cases short shifts are carried out (about 1.5 mm), but above all fine yarns are used, which contrast with a small force the shift thereof.

If fineness is lowered, e.g. fineness 14, the distance between two adjacent needles or shed becomes 1.8143 mm. The path to go on becomes longer, the time required becomes longer, voltage and current which the actuator has to be supplied with increase, since the latter has to bend more with the same length of the thread-guide and shifting pivot. The weight of the thread-guide increases (it is thicker), the count of the yarn used increases (thicker yarn), the forces to be overcome increase due to the thicker yarn, and therefore the actuator can no longer perform its task adequately since the force it can applied is not sufficient to overcome the various forces involved for keeping the thread-guide in the desired position.

Beyond the above, there is a less evident and less known phenomenon which strongly limits, in addition to the affects described above, the possibility of increasing the actual speed with which the movement is carried out with respect to the theoretical speed.

This phenomenon is given by the "shog" movement, i.e. the longitudinal shift of thread-guide bars.

This movement is made up of shifts to the left and to the right of the thread-guide bars, which movements fall within the space of at least one needle shed for Raschel jacquard looms.

Potentially, these movements can be very fast (in terms of shots per minute, i.e. to and fro) since they are obtained by way of some mechanical systems that can reach speeds above 3.000 to-and-fros per minute.

Basically, during the shog movement the thread-guide bar shifts to the right and to the left of a needle shed (1.0583 for fineness 24) between two end-of-stroke positions, thus continuously inverting its motion and shifting with the same shed at the above maximum speeds. Obviously, mechanical systems that are able to drive the machine at such speeds are quite complex and expensive, and the whole thread-guide bar system is sized accordingly.

The very fast movements described above require high accelerations and decelerations of the thread-guide bar and of the elements mounted thereon, which accelerations affect significantly the ability of a piezoelectric actuator to keep its position against an abutment. As a matter of fact, acceleration values achieved by the thread-guide bar are often such as to overcome the force keeping the thread-guide fastened to the mechanical abutment. This occurs when the shifting direction of the bar corresponds to the contact thread-guide/abutments, i.e. thread-guide abutting for instance onto the left stop and bar shifting to the left.

The operating speed of the machine cannot therefore be above given values, otherwise the thread-guide loses its stable position against the mechanical abutment. This phenomenon is strongly unwanted and adds to the others already described, which together strongly limit the possibility of increasing the number of shots per minute in the Raschel jacquard machine. Shots per minute are those of the needle bars operating synchronously with the thread-guide bars.

As a mere explanation, it should be pointed out that machines working at speeds near 3,000 shots do not make use of jacquard-type devices and only have stationary thread-guides, which are well fastened to their bars, so as not to be affected by thread pulling phenomena with the resulting tendency to be shifted axially, and obviously by the accelerations imparted to the bars in their to-and-fro movement during the knitting operation. The second known system for selectively shifting thread-guides makes use of elements adjacent to the thread-guides, which are suitably pulled and pushed so as to be able to place the thread-guide in a stable position against one abutment or the other (see documents U.S. Pat. No. 4,570,462 and U.S. Pat. No. 3,834,193).

This technical solution uses known "jacquard mechanical heads", very expensive and complex systems that are able to pilot by means of rods or cords the elements adjacent to the thread-guides and designed to shift them.

The most known jacquard heads of this type are "VERDOL®", applied first to healds looms and then also to Raschel looms (see for instance U.S. Pat. No. 4,702,286), which are able to develop high forces (kilos for pull and tens of hectograms in push, depending on the type of spring applied) and thus to firmly secure the thread-guide in the desired position, avoiding the risk that said thread-guide is deviated or detached from the assigned abutment and thus ensuring accuracy also for swift movements. These Jacquard heads, as was said above, beyond being complex and very expensive, are quite bulky and are typically applied in elevated position above the machine, above the thread-holding rollers, and are characterized by large cord bundles starting from the jacquard head up to the fastenings of the elements for shifting the thread-guides.

These systems are suitable for carrying out large shifts of thread-guides (required for low finenesses, such as 3, 4, 5 up to 16 depending on the type of structure) and for processing quite thick yarns which are hard to shift.

Such technical solution is reliable and fast (about 800 shots/minute) thanks to the robust constructive features, to the fastening systems used and to the systems for engaging the elements for shifting the thread-guides with the latter.

Thread-guides have projections (shaped as folds) interacting with the projections of the shifting elements controlled by the Jacquard mechanical head, which move up and down so as to carry out their task. However, it should be pointed out that the positioning of the various elements in narrow spaces such as those designed for the shift of the thread-guides between two adjacent needles creates many problems both during construction and during knitting and maintenance operations.

During construction this requires the use of robust and heavy supports apt to support the forces involved (pull and push in particular). These elements affect the size of the Jacquard thread-guide bars, which become larger and therefore heavier and less easy to be shifted both during SWING and during SHOG of said bars.

The spaces occupied by the elements for shifting the thread-guides are taken from those available, thus sacrificing spaces that are ergonomically useful or essential for the passage of weaving threads and for regular maintenance operations in case of thread break and resulting recovery knotting.

As a consequence, finding a broken thread, hooking and knotting the latter become very slow and hard operations requiring specific tools and abilities, exactly because the spaces involved by thread trajectories are occupied by additional mechanical elements such as those designed to shift the thread-guides, which unfortunately cannot be moved from their position.

In jacquard devices it is further known about the use of systems apt to prevent the thread from getting into the spaces designed for the thread-guides (see for instance U.S. Pat. No. 5,561,989 of Oct. 8, 1986).

Here like elsewhere, the protection of the threads so that they do not get in contact with the thread-guides consists in a housing developing on the whole length of the body of the piezoceramic actuator, wholly covering the latter in its front portion. Said housing has in its upper portion a projection acting as guide edge for all threads coming from above, determining the trajectory of said threads between the upper contact of the projection and the lower contact of the housing. Since there is no space for screws for securing said housing in the lower area near the hole of the thread-guide, so that it keeps its position without vibrations, a profile (projection) was obtained in the upper portion, designed to delimit the thread trajectory but especially acting as spring tie rod for preventing housing detachment.

The two contact points of the thread in its operating trajectory lie both on the body of the piezoceramic actuator assembly.

The present invention aims at solving the problems of the prior art by proposing a jacquard device for selectively shifting thread-guides in a knitting machine, which is free from the described drawbacks.

A particular aim of the present invention is to disclose a selection system combining the advantages of the two different known technologies described above, solving the problems that prevented up to now their combined used due to their different mechanical-textile features.

A further aim of the present invention is to provide a system for selectively controlling the shift of the thread-guides, which is able to operate safely at high speeds with a very broad range of different finenesses, developing a sufficient force for moving the thread-guide shifting elements from long distances for this type of applications, preventing at the same time the occurrence of phenomena involving the detachment and bouncing of the thread-guide from its abutment, which affect systems making use of piezoelectric plates.

Another aim of the present invention is to propose a control device for thread-guide bars of linear knitting machines, which is highly accurate and reliable, and wherein the clearances between the various components are minimized, thus enabling to obtain high-quality finished items.

A further aim of the present invention is to mitigate the hard working conditions often occurring in the textile field, particularly in the case of jacquard mechanical heads as described above, giving rise to ergonomically more favorable conditions and highly simplifying work for operators working in this field, creating sufficient space for threading operations and simplifying maintenance operation in case of failure or malfunction. Another aim of the present invention is to propose a jacquard device for selectively shifting thread-guides in a knitting machine, which is simple to carry out and not very expensive both as far as construction and operation as well as maintenance are concerned, and which further has a robust and compact structure.

A further aim of the present invention is to provide a device enabling to prevent threads from getting into the seats housing the thread-guides in a movable manner, which has a simpler, less bulky, cheap and technically more functional construction than known solutions.

A final aim of the invention is to provide a device provided with a pneumatic connection system ensuring a firm positioning of the thread-guide also in case of very small size, such as high finenesses e.g. fineness 24. These and other aims, which will be apparent in the following description, are achieved according to the present invention by a jacquard device for selectively shifting thread-guides in a knitting machine in accordance with the appended claims.

Further characteristics and advantages of the invention will be more evident from the description of a preferred, though not exclusive embodiment of the device shown to a merely indicative purpose in the following drawings:

FIG. 1 shows a side view of two jacquard devices or bars for selectively shifting thread-guides in a linear knitting machine according to the invention, wherein the two devices are partially shown and are mounted onto a suitable bar-holding support together with two thread-guide bars whose thread-guides are of fixed type (four other bars to be mounted in the left portion of the support are not shown);

FIG. 2B shows a side view of a thread-guide wrapping the thread around the head of a needle;

FIG. 2C is a front view of the thread-guide of FIG. 2B;

FIGS. 2D and 2E are two details of thread-guides in a first and in a second operating position, respectively, wherein they rest onto side portions of right and left ends-of-stroke, respectively;

FIG. 6 shows a side view of the lower portion of the supporting element of the device of FIG. 3, with a covering element detached from the supporting element;

FIG. 6A shows a front view of the lower portion of the supporting element shown in FIG. 6;

FIG. 6B shows a detail of the view of FIG. 6, with a covering element applied onto the supporting element;

FIG. 6C is a perspective view of the covering element shown in FIG. 6, with a plurality of threads in contact with the latter;

FIG. 15 shows a detail of the interconnection between some air pipes and corresponding air ducts obtained in a body integral with the supporting element of the device;

FIG. 15A shows a connecting element of the interconnection of FIG. 15 in a partially sectioned view;

FIG. 15B shows a seal for the interconnection of FIG. 15 in a sectioned view.

With reference to the figures mentioned above, a jacquard device 1 for selectively shifting thread-guides 2 in a knitting machine according to the invention comprises at least one supporting element 3 provided with a plurality of housing seats 4 for a plurality of thread-guides 2.

Figure 5:
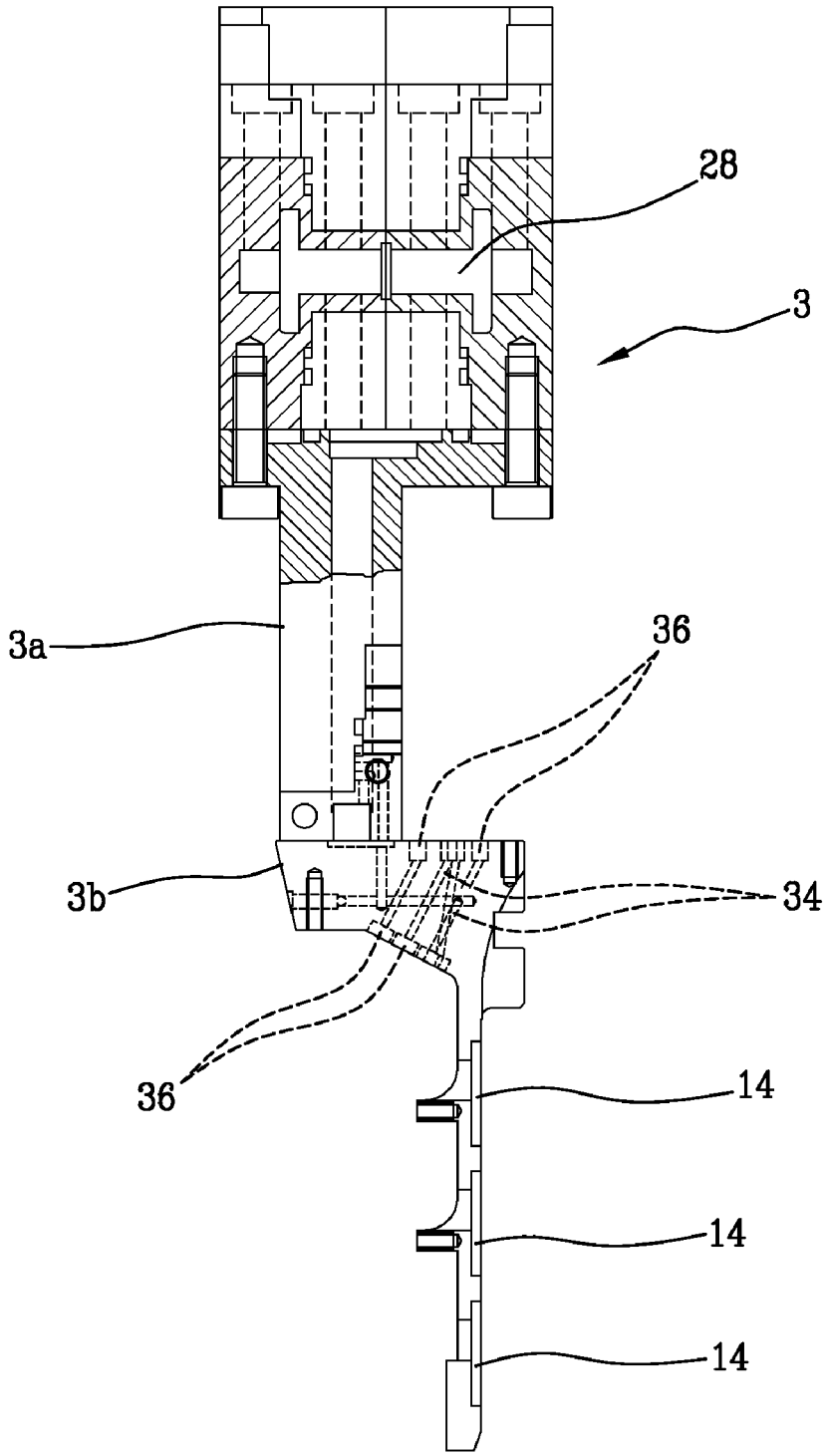
FIG. 5 is a side view of an upper portion of a supporting element of the device of FIG. 3.
Figure 5A:
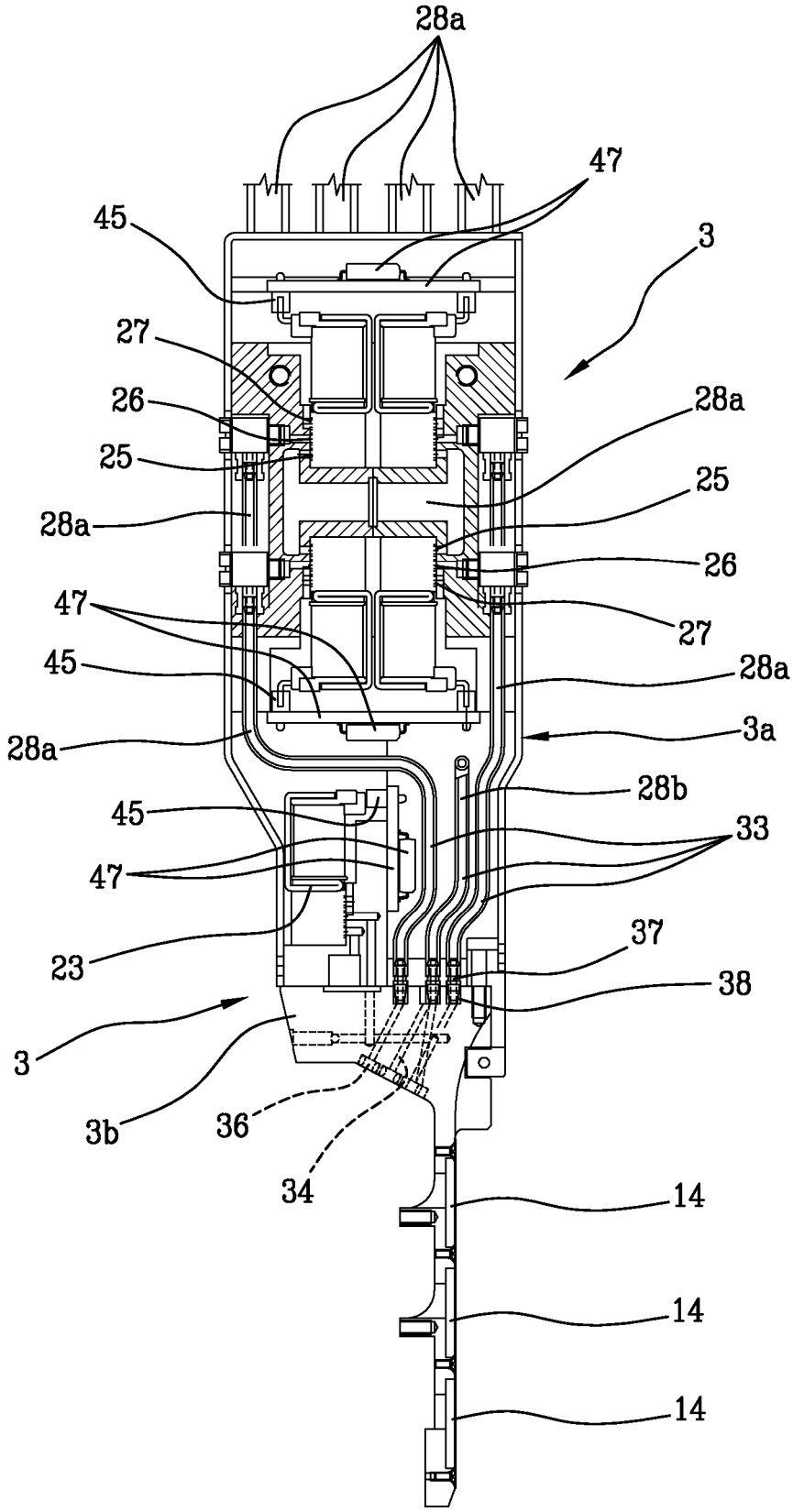
FIG. 5A is a view similar to the one of FIG. 5, wherein some additional elements of the device of FIG. 3 are mounted onto the support.
Figure 5B:
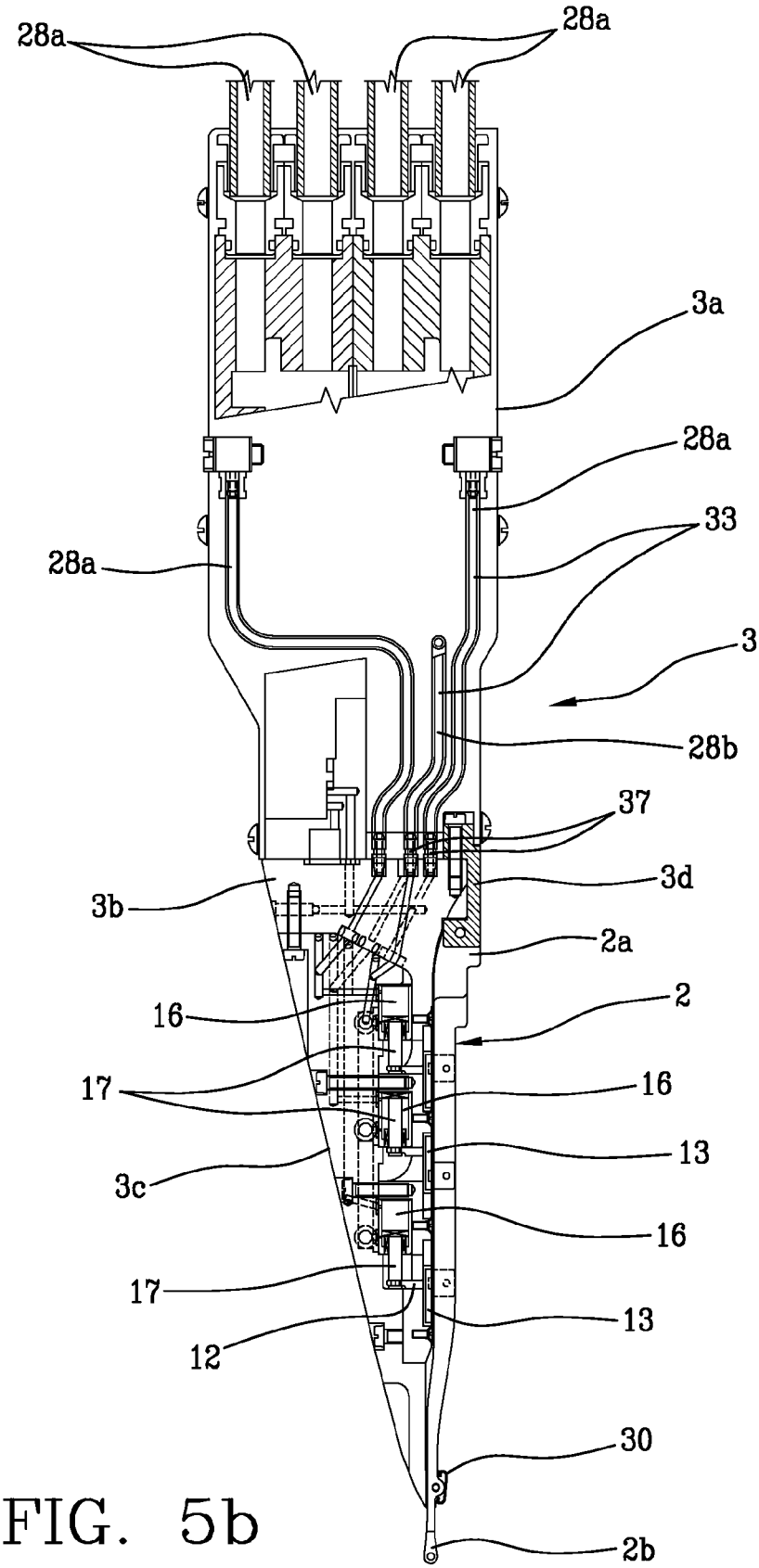
FIG. 5B is a view similar to the one of FIG. 5, partially broken, wherein other additional elements of the device of FIG. 3 are mounted onto the support, together with a lower portion of the supporting element, and corresponding to a partial section of the device of FIG. 3.
Figure 8:
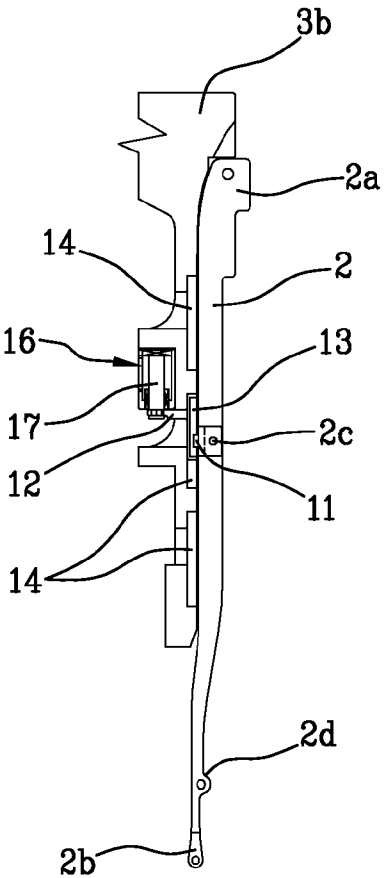
FIGS. 8, 8A and 8B show the three thread-guides of FIG. 7 in side view, respectively, mounted onto corresponding supports and shown with their actuating elements and with their pneumatic devices.
Figure 8A:
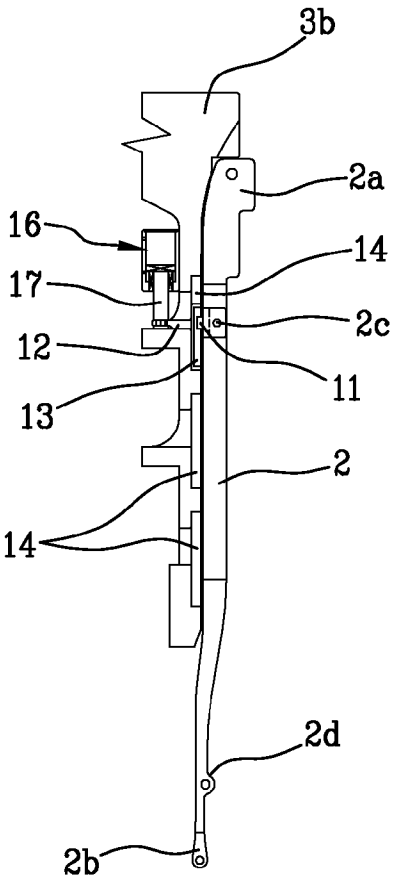
Figure 8B:
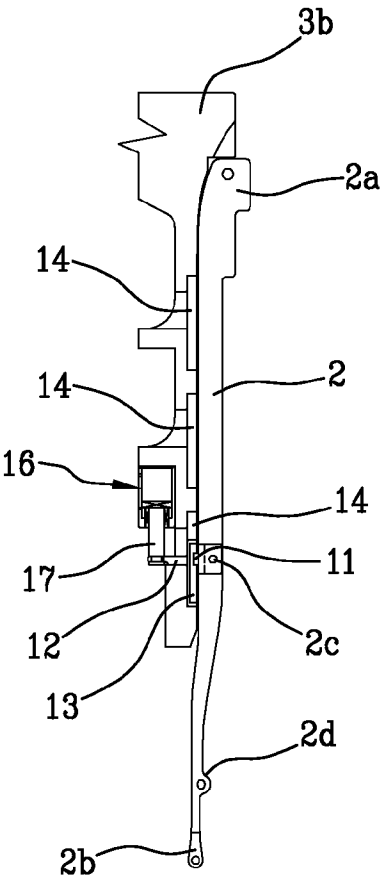

Preferably, the supporting element 3 can comprise an upper portion 3*a* (FIG. 5) (further divided into other subportions), at least one intermediate portion 3*b* and a lower portion 3*c* (FIGS. 6 and 6A).

In the preferred embodiment disclosed here, the supporting element 3 is jacquard-type thread-guide bar for a warp linear knitting machine and is movable (in accordance with known technique at least with usual SWING and SHOG movements)

with respect to at least one bed 5 of needles 6 for selectively feeding a thread 7 to the needles of said needle bed.

The machine of the example disclosed here (not shown as a whole since it is of known type) is equipped with two jacquard devices for each bed 5, 5*a* of needles 6, since on a first device 1 there are only odd thread-guides apt to operate on odd needles of the needle bed, and on the second device 1 there are only even thread-guides apt to operate on even needles of the needle bed.

Figure 1:
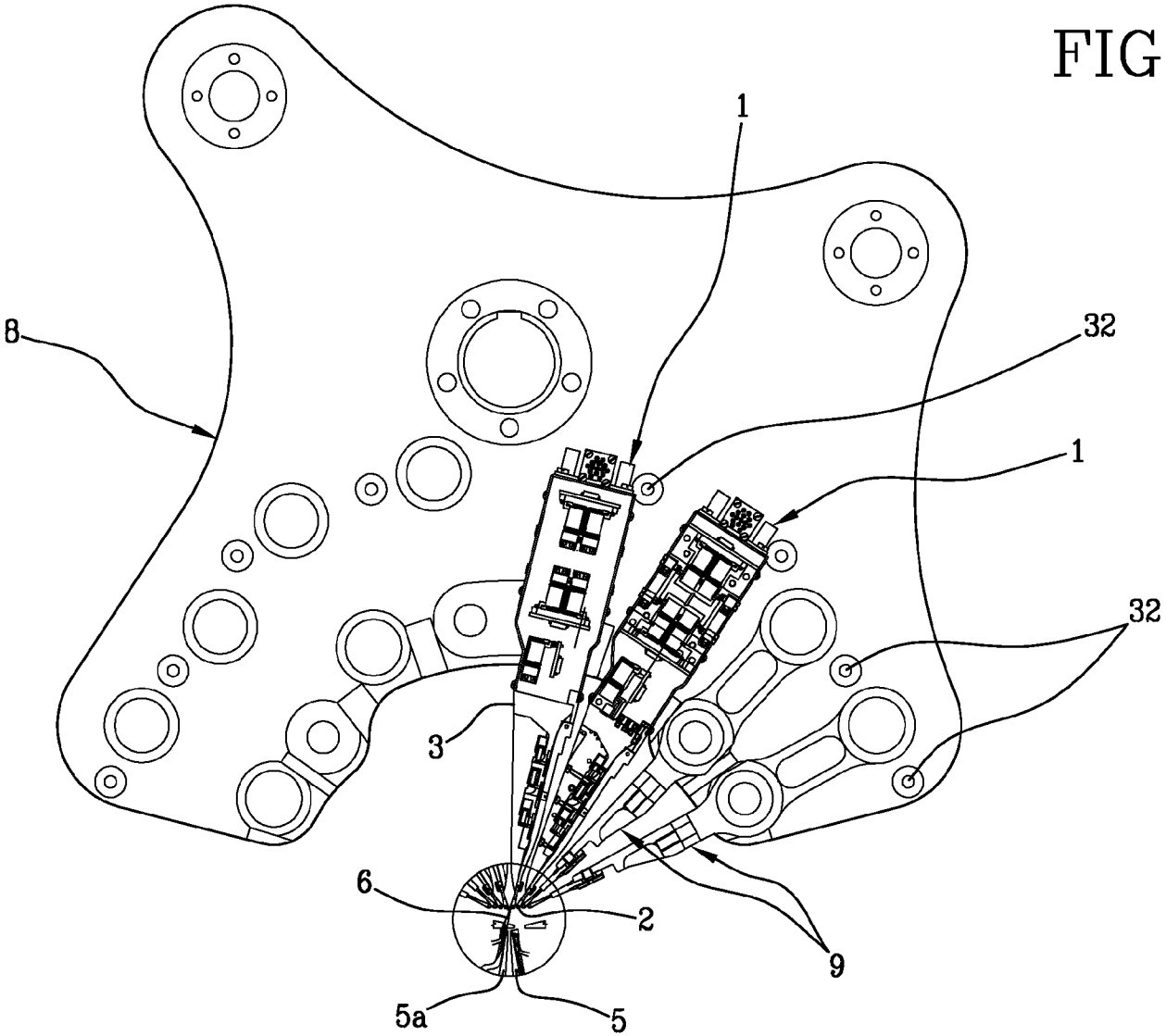
FIG. 1A shows a detail of FIG. 1 concerning only two jacquard devices or bars, which are identical but shown both partially so as to shown different parts of the device.
Figure 1A:
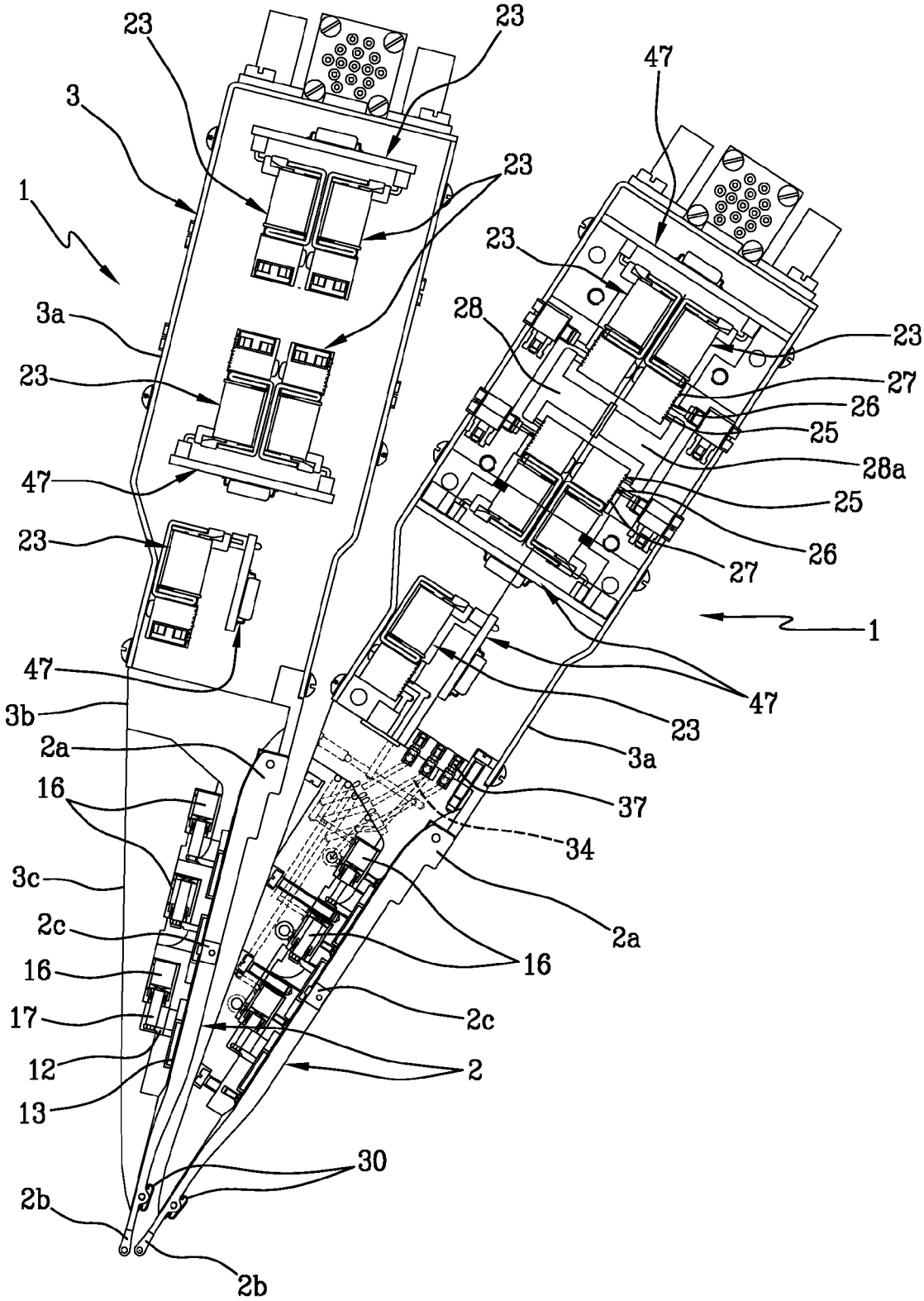
Figure 2A:
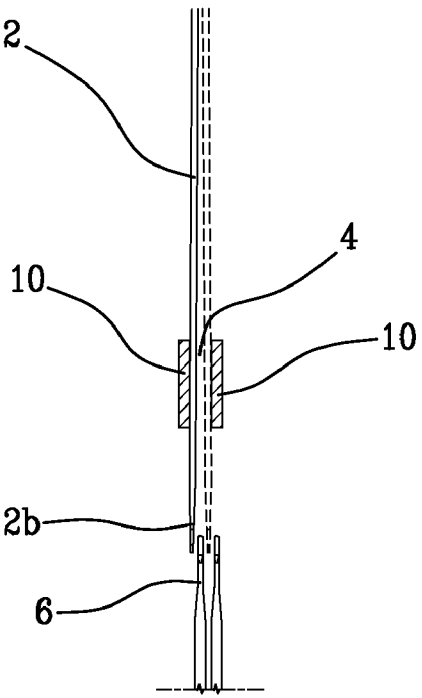
FIG. 2A shows a front view of a detail of a thread-guide mounted onto a jacquard bar and moving between two operating positions with respect to a needle.
Figure 2:
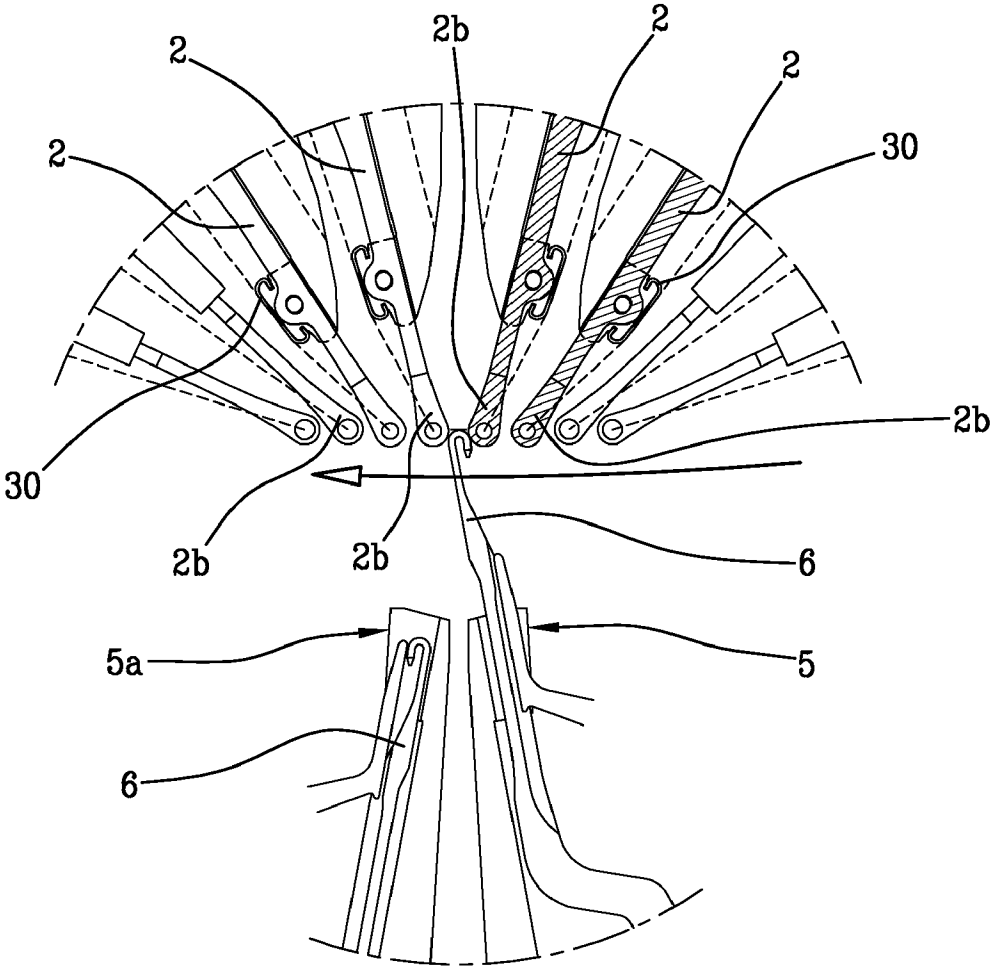
FIG. 2 shows a side view of a detail of warp linear knitting machine with double needle bed, with four jacquard bars according to the invention and four fixed thread-guide bars.

In particular, as shown in FIGS. 1 and 2, the machine according to the present embodiment is equipped with two needle beds 5, 5*a* and with eight thread-guide bars, four with conventional fixed thread-guides and four with moving or jacquard thread-guides according to the invention.

FIG. 1 shows for simplicity's sake only the four bars on the right of a bar-holding support 8, which operate on the first needle bed 5, whereas the other four bars on the left apt to operate on the second needle bed 5*a* and symmetrical with respect to the first four are not shown.

The two outer bars 9 are of conventional type with fixed thread-guides, whereas the middle bars are of the type with jacquard moving thread-guides according to the present invention.

Figure 3:
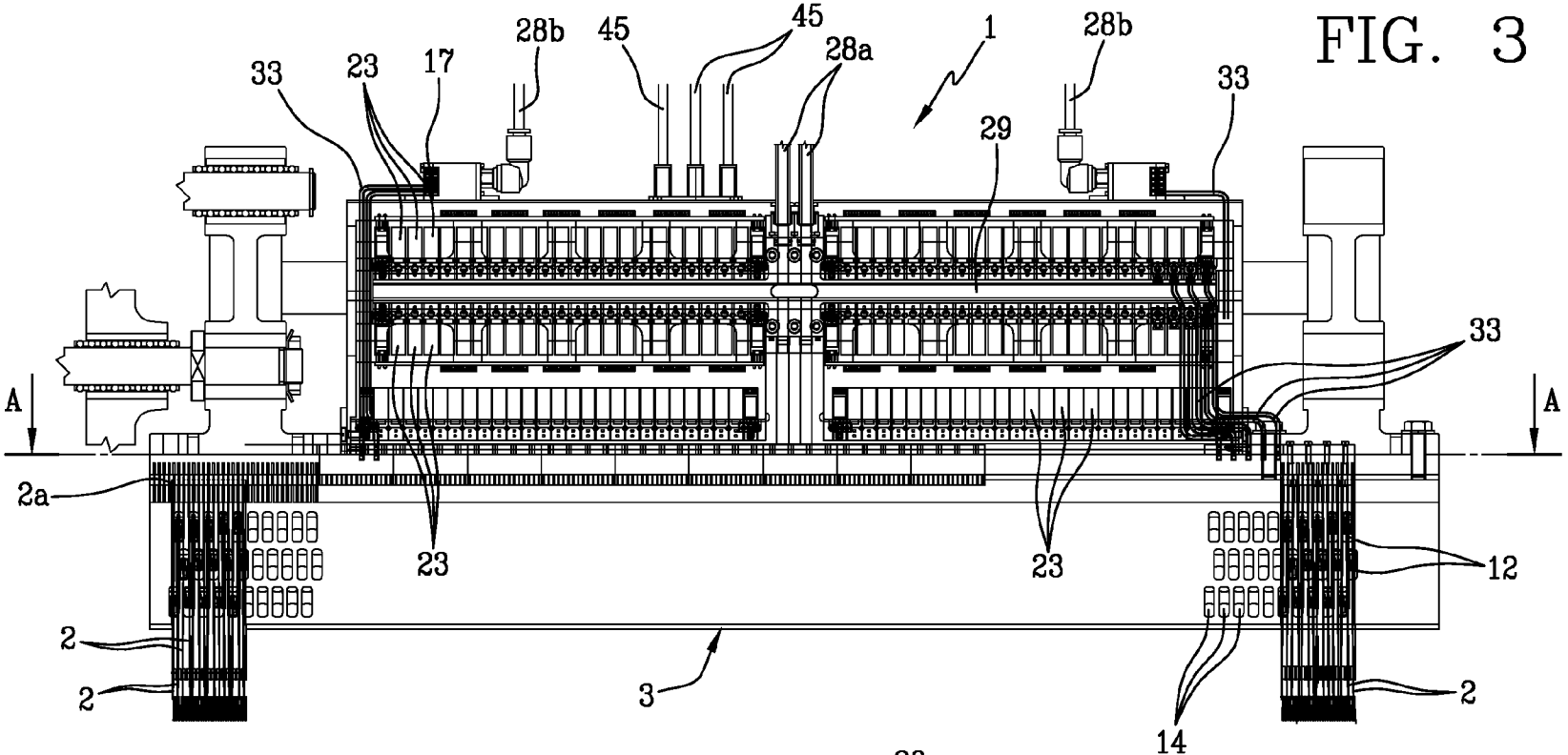
FIG. 3 is a front view of a jacquard device for selectively shifting thread-guides in a linear knitting machine according to the invention, wherein some parts have been removed for clarity (in particular, some components of the device are not shown and only some of the thread-guides are shown)
Figure 3A:
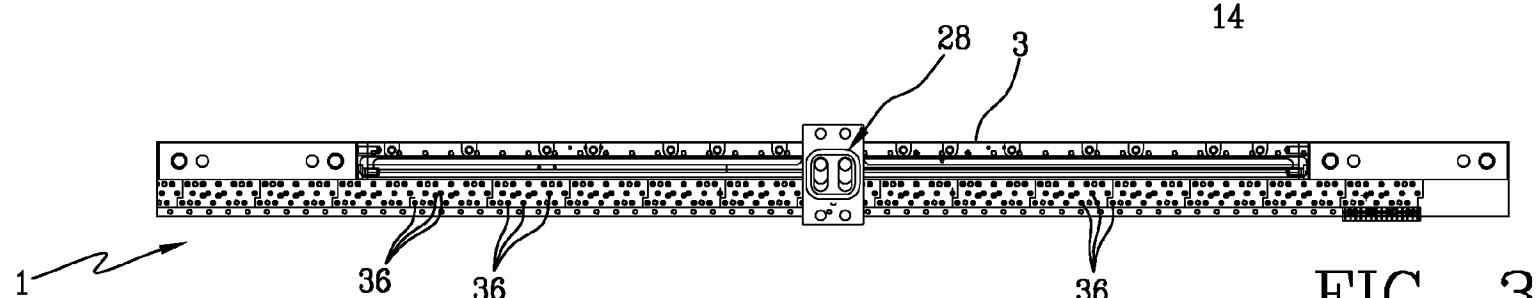
FIG. 3A is a section from above of the device of FIG. 3 according to plane A-A.
Figure 4:
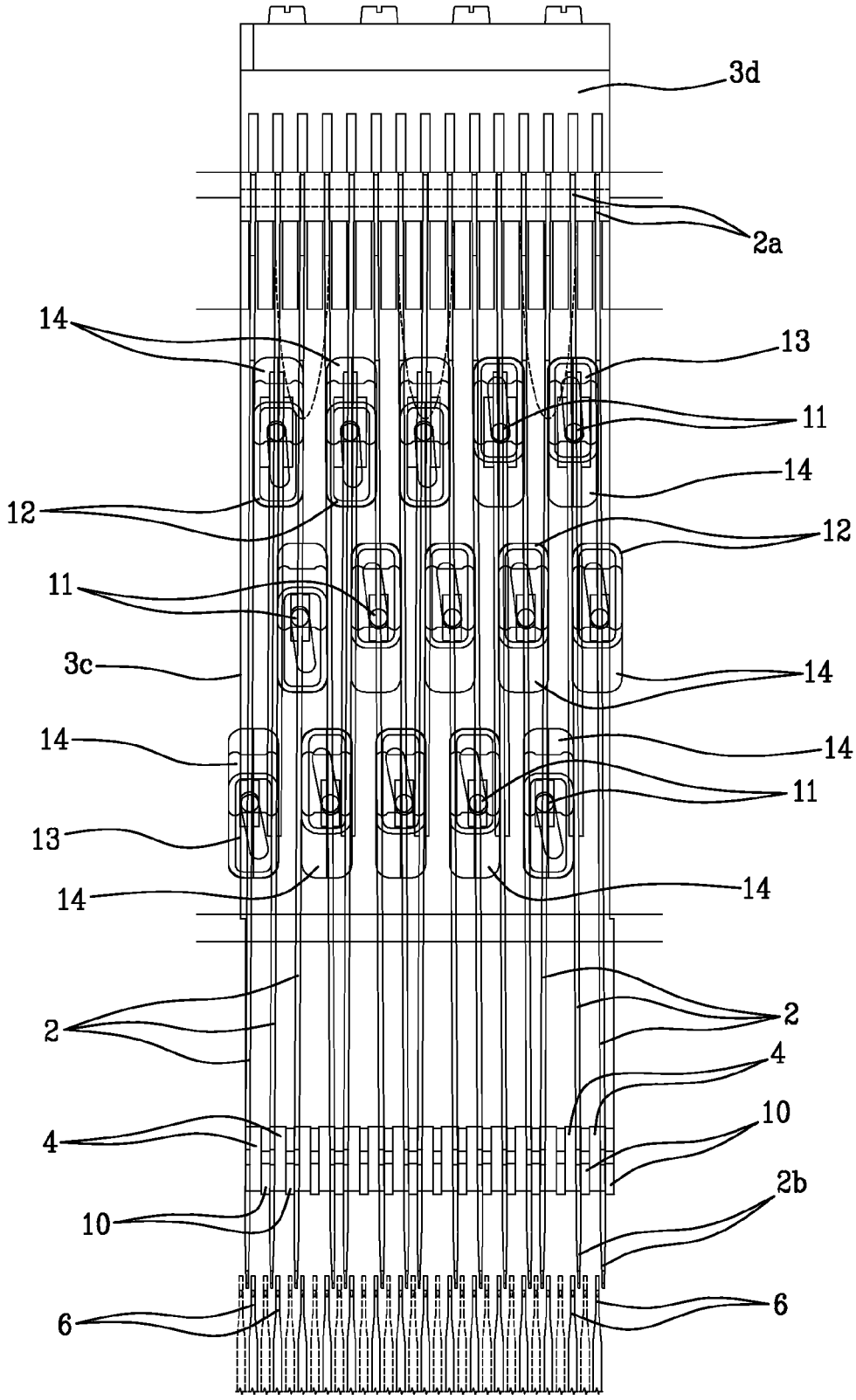
FIG. 4 shows a detail of the device of FIG. 3 concerning a group of thread-guides mounted onto corresponding supports.

As can be seen in further detail in FIGS. 3 and 4, the device 1 comprises a plurality of thread-guides 2 having each at least one mounting seat 2*a* on which they are mounted onto the supporting element 3 by way of a further mounting element 3*d*, and at least one pierced thread-guide portion 2*b* selectively moving between a first and second operating position and apt to guide a thread 7. Each housing seat 4 of the lower portion 3*c* of the supporting element 3 is equipped with side end-of-stroke portions or stops 10 apt to determine the first and the second operating position of the thread-guide portion 2*b* of the thread-guide 2 mounted in said housing seat 4.

FIG. 2A shows the two positions of a thread-guide 2 with respect to a needle 6, the position in which it is beside the left stop 10 and therefore is placed on the left of a needle 6, and the other position (in which the thread-guide 2 is represented only partially) in which it is beside the right stop 10 and therefore is placed on the right of a needle 6.

Figure 10:
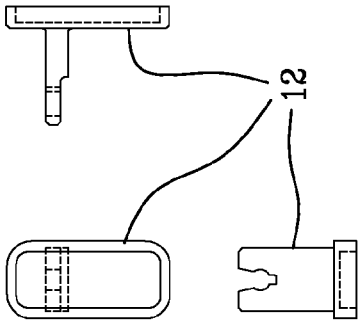
FIG. 10 shows the actuating element of FIG. 9 in three orthogonal views.
Figure 9:
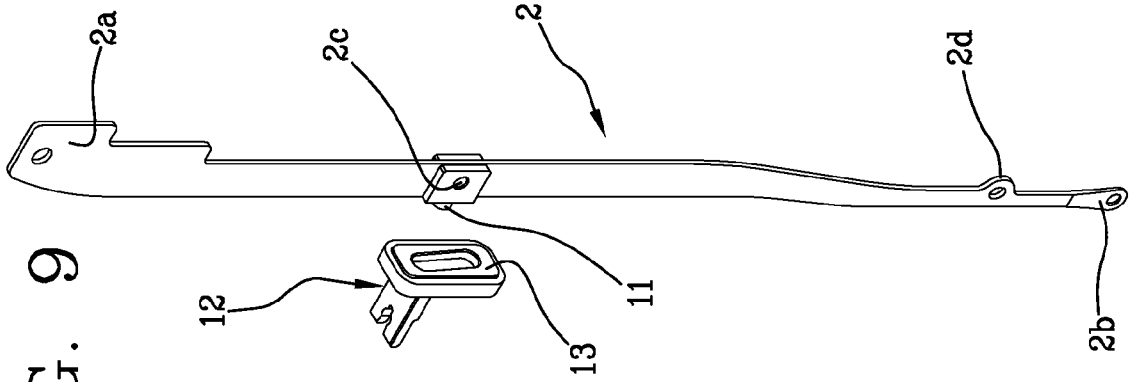
FIG. 9 shows a perspective exploded view of a thread-guide and of a corresponding actuating element.

FIGS. 2D and 2E show a pair of thread-guides 2 placed in one case beside the corresponding left stops 10, in the other case beside the corresponding right stops 10. As can be seen in detail in FIG. 9, each thread-guide further comprises an actuating portion 2*c* on which an engagement element 11 is located, and a guide portion 2*d* pierced and apt to cooperate with an elongated guide element 46 (which can be seen in FIG. 6*b*) getting through a plurality of thread-guides 2. The device 1 further comprises at least one actuating element 12 (see FIGS. 9 and 10) acting upon at least one thread-guide 2, and in particular on each thread-guide 2, so as to shift the thread-guide portion 2*b* of the thread-guide from the first operating position to the second operating position. The device 1 therefore comprises a plurality of actuating elements 12 or "sliders" each associated to a corresponding thread-guide 2.

Figure 11:
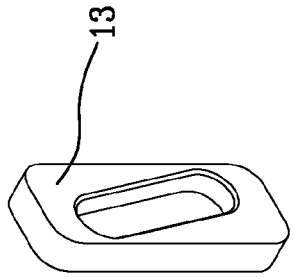
FIG. 11 shows a cam-shaped element which is part of the actuating element of FIG. 10.

Each actuating element 12 is equipped with a cam-shaped element 13 shown in FIG. 11 (shifting cam made up for instance of a plate with an inclined recess) cooperating with the engagement element 11 of the corresponding thread-guide so as to convert the movement of the actuating element 12 into a pre-established movement of the actuating portion of the thread-guide 2 and therefore of the thread-guide portion 2*b* of the thread-guide.

Figure 7:
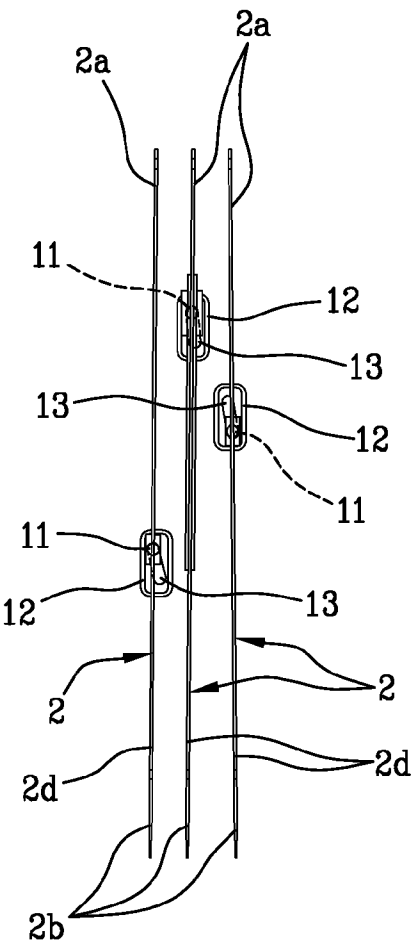
FIG. 7 is a front view of three thread-guides adjacent to one another and connected to corresponding actuating elements in different operating positions and arranged at three different heights.

In particular, as shown in FIGS. 4 and 7, the camshaped element 13 is apt to convert the vertical movement of the actuating element 12 inside a suitable operating seat 14 thereof associated to or obtained in the intermediate portion 3*b* of the supporting element 3, into a side movement (from right to left), and conversely, of the thread-guide portion 2*b* of the corresponding thread-guide.

If the machine has a needle fineness making it necessary, preferably the actuating elements 12 are arranged spaced apart on at least two rows at different heights, so that the actuating devices 12 connected to adjacent thread-guides are arranged on different rows, and in particular in the preferred embodiment they are arranged at three heights (as shown in FIGS. 3, 4, 7, 8, 8A, 8B). As will be explained in detail later, this enables to observe the small distances between one thread-guide 2 and the other, in case of high finenesses, even though the actuating devices 12 are excessively bulky.

The device 1 further comprises at least one electropneumatic actuating device 15 (FIGS. 12 and 13) operatively connected to each actuating element 12 so as to move the actuating element 12, and therefore the thread-guide portion 2*b* of the corresponding thread-guide between the first and the second operating position. The device 1 therefore comprises a plurality of electropneumatic actuating devices 15 each operatively connected to a corresponding actuating element 12.

Figure 12:
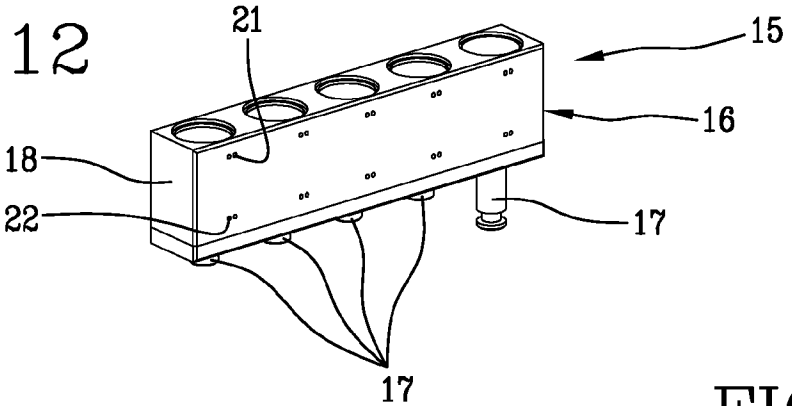
FIG. 12 is a perspective view of a pneumatic device according to the invention.
Figure 12B:
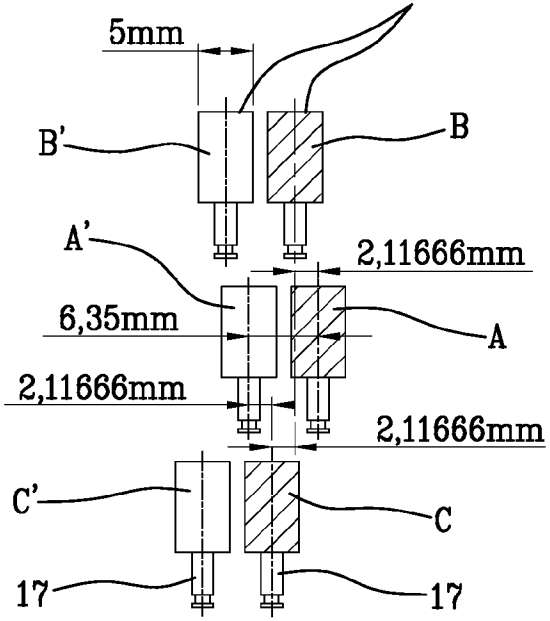
FIG. 12B is a schematic front view of three pneumatic devices in a single configuration showing the spatial arrangement and the distances thereof.
Figure 12A:
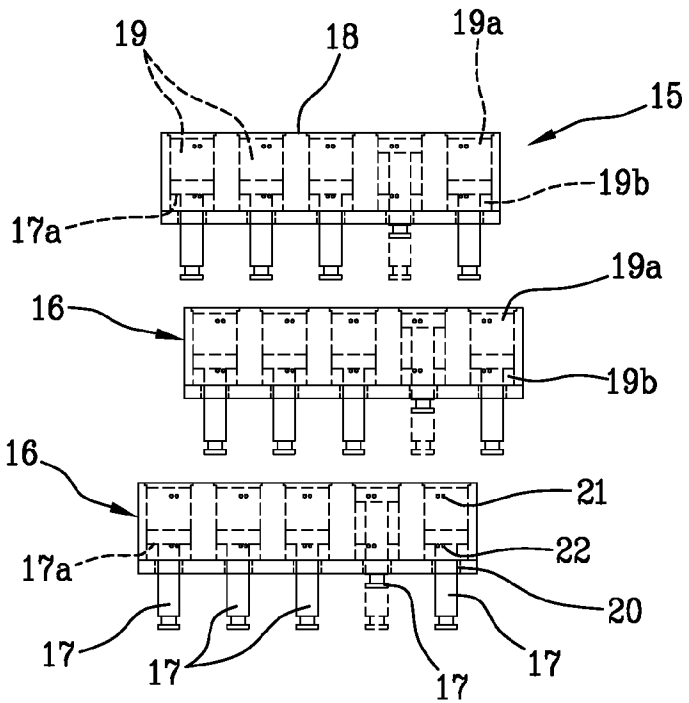
FIG. 12A is a front view of three pneumatic devices as the one of FIG. 12, arranged at three heights and spaced apart from one another.

As shown in FIGS. 12, 12A and 12B the electropneumatic actuating device 15 further comprises at least one pneumatic device 16 having a moving element (or piston) 17 connected to the actuating element 12 (FIG. 8), which can be selectively shifted between a forward and a backward position.

The pneumatic device 16 comprises a housing body (or "case") 18 in which at least one sliding seat 19 is located, which houses movingly the moving element 17, thus constituting a pneumatic piston.

The housing body 18 is provided on the sliding seat 19 with at least one main opening 20 apt to enable the passage of the moving element 17 and the movement thereof between the forward and the backward position (see FIGS. 12 and 12A).

The housing body 18 is further provided on the sliding seat 19 with at least a first air opening 21 (two holes for instance) and with at least a second air opening 22 (two holes for instance), the first opening 21 being apt to enable the introduction of compressed air P (for instance at a pressure of about 0.55 MPa) into a first portion 19*a* of the sliding seat 19 so as to push the moving element to its forward position, whereas the second opening 22 is apt to enable the introduction of compressed air Pa in counter-pressure (for instance at a pressure of about 0.35 MPa) into a second portion 19*b* of the sliding seat 19 so as to push the moving element 17 to its backward position.

The moving element 17 is provided with at least one pushing portion 17*a* on the second portion 19*b* of the sliding seat 19 so as to enable compressed air getting in from the second opening 22 to push the moving element 17 to its backward position.

Preferably, each housing body 18 is equipped with a plurality of seats 19 for housing a plurality of moving elements 17, and in the preferred embodiment shown here each housing body 18 is provided with five sliding seats in which the same number of moving elements 17 shifts (FIGS. 12 and 12A).

As is shown in FIGS. 8-8B, 12 and 12B, advantageously also the moving elements 17 of the pneumatic devices 16 are placed spaced apart on at least two rows at different heights, and in particular at three heights, so that moving elements 17 connected to adjacent thread-guides 2, by way of corresponding actuating devices 12, are arranged on different rows. This enables to observe the small distances between one thread-guide and the other even though the pneumatic devices are bulkier, in case of high finenesses.

Figure 13A:
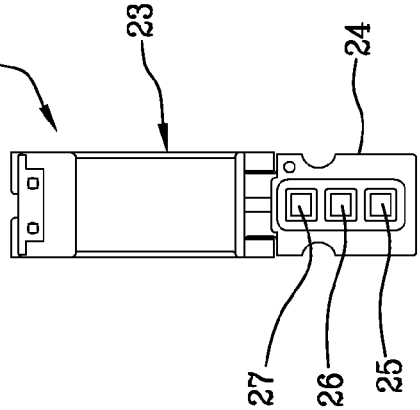
FIGS. 13 and 13A show a perspective view and a front view, respectively, of an electropneumatic valve according to the invention.
Figure 13:
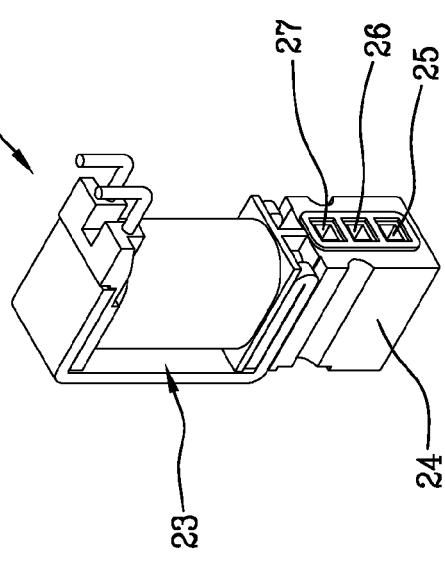

The electropneumatic actuating device 15 further comprises at least one electropneumatic valve (or solenoid valve) 23, shown in detail in FIGS. 13 and 13A, operatively connected, preferably by way of air pipes 33 and air ducts obtained in the supporting element 3, to a pneumatic device 16 so as to selectively shift the moving element 17 supplying said pneumatic device 16 with compressed air.

Advantageously, the device 15 comprises an electropneumatic valve 23 connected to each pneumatic device 16, and in particular an electropneumatic valve 23 for each moving element 17.

Each electropneumatic valve 23 is equipped with at least one valve body 24 for air communicating with the outer environment by means of an air inlet opening 25, an air outlet opening 26, operatively connected to the corresponding pneumatic device 16 on the first opening 21 thereof, and an exhaust opening 27 for evacuating air into the environment.

The device 1 further comprises a pneumatic supply system 28 comprising a main pneumatic supply system 28*a* (or main pneumatic bus) apt to supply each electropneumatic valve 23 with inlet compressed air P, connected in particular to the corresponding air inlet openings 25 of each electropneumatic valve.

The pneumatic supply system 28 further comprises a counter-pressure pneumatic supply system 28*b* (or counter-pressure bus) operatively connected directly to each pneumatic device 16 on said second openings 22 thereof so as to enable the introduction of compressed air Pa into said second portions 19*b* of the sliding seats 19 and to push each moving element 17 to its backward position when the corresponding electropneumatic valve 23 is able to evacuate air from the exhaust opening 27.

The counter-pressure pneumatic supply system 28*a* further comprises a pressure reducing device 29 operatively arranged upstream from the second opening 22 of the pneumatic system 16 so as to supply said pneumatic devices 16 with a reduced pressure or counter-pressure Pa.

Figure 14:
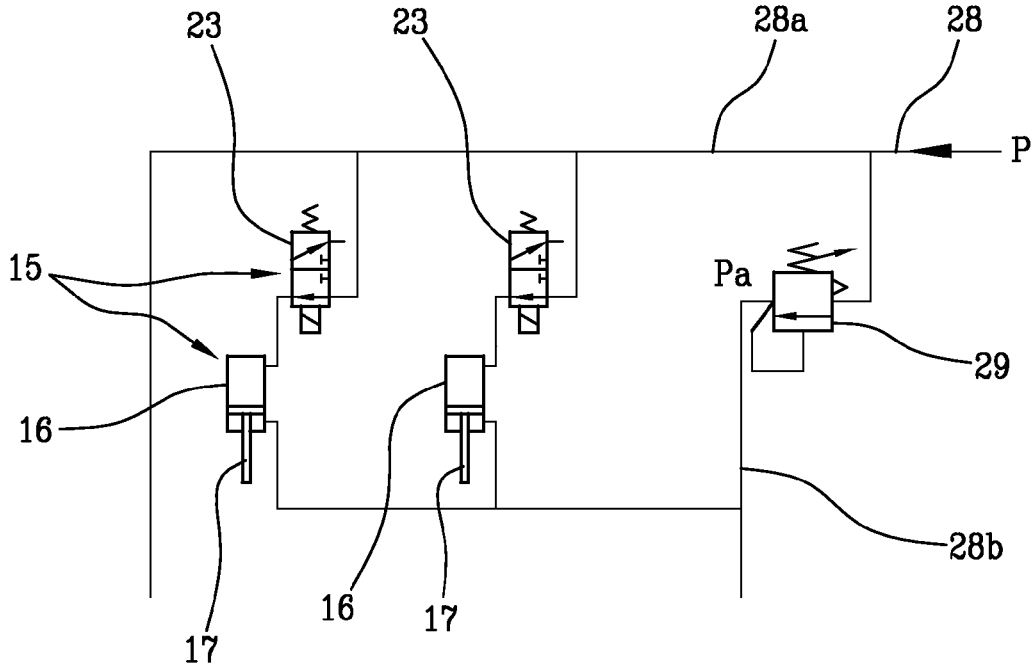
FIGS. 14 and 14A are schematic views showing with a block diagram the operation of the pneumatic device according to the invention in two operating positions.
Figure 14A:
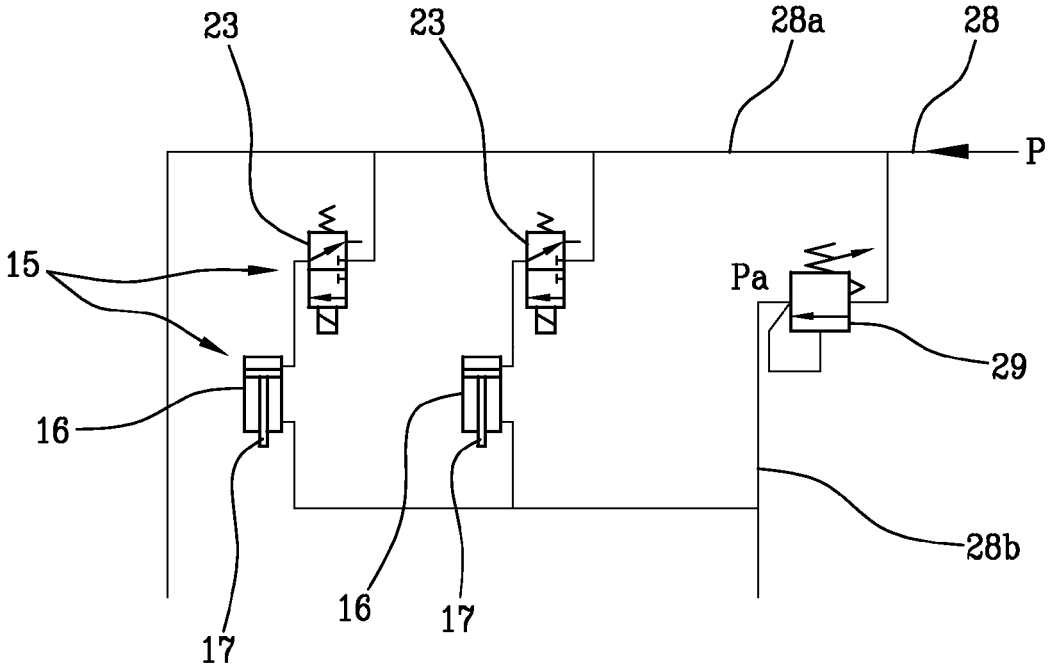

The supply system 28 is schematically shown in FIGS. 14 and 14A, in which the inlet of pressurized air P supplying the inlet of the electropneumatic valves 23 can be seen, which valves are in their turn connected to the pneumatic devices 16. Moreover, the pressure reducer 29 can be seen, from which air Pa is sent to the second opening 22 for compressed air of the pneumatic devices 16 so as to act as a "pneumatic spring" which is always active, no matter if the solenoid valves 23 are activated or not.

FIG. 14 shows the first operating condition in which the two electropneumatic valves 23 supply the corresponding pneumatic devices 16 with pressurized compressed air P, causing the shift of the moving elements 17 to their forward position, whereas FIG. 14*a* shows a second operating condition in which the two electropneumatic valves 23 do not supply with compressed air P the pneumatic devices 16 (closing the inlet opening 25 for compressed air in said solenoid valves) and are in exhaust position in which air is evacuated into the outer environment (the outlet opening 26 and the exhaust opening 17 are open), so that compressed air at lower pressure Pa supplied by the pressure reducer 29 to said pneumatic devices 16 causes the shift of the moving elements 17 to their backward position and the return of air to be evacuated to the electropneumatic valves 23. The device 1 further comprises an electric supply system or electric bus 45 (FIG. 3-5*a*) for supplying the solenoid valves 23.

The electric supply system 45 further comprises a plurality of control devices 47 for the solenoid valves 23, e.g. electronic control cards, which are not described in detail since of per se known type, operatively connected to the electropneumatic valves 23 so as to control the movement of the thread-guide portions 2*b* of the thread-guides 2 in accordance with a pre-established jacquard operating program, and further connected (for instance by way of said electric bus 45) to a control device for the device 1 and thus to control means for the machine (both are not shown or described in detail since of per se known type).

As can be seen in FIGS. 6, 6A and 6B, according to the present invention, the device 1 further comprises at least a covering element 30, made up for instance of a metal sheath, apt to cover at least one portion of said housing seats 4 of the supporting element 3 for supporting the threads 7 inserted into the thread-guides 2, guiding the sliding of said threads 7 and prevent said threads 7 from getting into the housing seats and from interfering with the movement of the thread-guides 2. The covering element is mounted onto the supporting element 3 (onto the lower portion 3*c* thereof) near the side end-of-stroke portions or stops 10 so as to cover at the same time a plurality of housing seats 4 for the thread-guides 2, and it is advantageously fitted onto corresponding engagement seats 31 obtained on said supporting element 3.

As is shown in FIG. 6, the metal sheath 30 is advantageously inserted into the lower portion 3*c* of the housing (the supporting element 3) for the thread-guides 2 in the supporting element 3, and the engagement seats 31 on the housing are suitably shaped so as to preload the sheath 30, so that said sheath 30 can then be taken off and repositioned without using glue or screws. Actually, the sheath 30 is pressed in and prevents the thread 7 from getting into the housing seats 4 in which operate the thread-guides 2, and acts at the same time as safe guide for said threads 7. Preferably, the sheath 30 is as long as a housing (shown in FIG. 6A) of the supporting element 3 and, when it is mounted and the housings lie close to one another, it leaves no space to the thread 7 for penetrating between one sheath 30 and the other.

IN FIG. 6 the covering element 30 is separated form the lower portion 3*c* of the supporting element 3, whereas in FIG. 6B the covering element 30 has been applied onto the supporting element 3 so as to cover the housing seats 4 of the thread-guides 2.

FIG. 6C shows the operating condition of the covering element supporting a plurality of threads feeding corresponding thread-guides 2.

As can be seen in FIG. 1, preferably the device 1 further comprises an additional supporting element 32 for the thread, for instance a metal wire, arranged upstream from the covering element 30 with respect to the feeding path of the thread 7 and basically near the upper portion of the thread-guide bars 3.

It should be pointed out that said additional supporting element 32 could also be placed elsewhere, provided that in such position it can adequately support the thread 7 together with the covering element 30.

According to the invention, therefore, the trajectory of the thread 7 preferably has its contact points in two separate areas, one directly on the body of the supporting element 3 (on the metal rod 32 suitably placed), the other one is the one of the small metal sheath 30 lying very close to the hole of the thread-guide portion 2*b* of the thread-guide 2.

This results in a simpler, less bulky, cheap and technically more functional construction than in the prior art, since the rod placed at a good distance (higher than the cover known of piezoceramic assemblies) enables to establish for all assemblies one contact position, which can be easily determined during the design step and requires no adjustment. As a matter of fact, this solution makes the trajectory of the thread 7 highly accurate thanks to the fact that the tract concerned by the two contact points is greatly spaced apart, and positioning mistakes of both cause small angular shifts, preventing the thread 7 from getting in contact with the thread-guide 7.

It should be pointed out that the rod 32 and the sheath 30 move together since both are secured on the supporting element 3 (or swing supporting body).

Moreover, it should be pointed out that the covering element 30 according to the invention effectively applies also to non-electropneumatic jacquard devices, and therefore also to piezoelectric, mechanical or other jacquard devices. The same applies to the additional supporting element 32.

As is shown in FIG. 15, according to the present invention, the device 1 further comprises at least a compressed air pipe (or tube) 33, at least a compressed air passage duct 34 obtained in a body 35 integral with or part of the supporting element 3 and provided with an inlet seat 36, at least one connecting element 37 or barbed fitting (shown in partial section in FIG. 15A), hollow inside and provided with two ends 37*a*, 37*b* having an outer surface that is at least partially conical and apt to connect the air pipe 33 to the passage duct 34. The device 1 further comprises at least one seal 38 (shown in section in FIG. 15B) apt to be inserted into the inlet seat 36 for compresses air of said body 35 and having an outer round shape and an inner surface that is at least partially conical and apt to fit into a lower end 37*a* of the connecting element or barbed fitting 37. It should be pointed out that the partially conical inner surface of the seal 38 cooperates effectively with the lower end 37*a* of the connecting element 37 and ensures a good sealing in the compressed air circuit even in case of very small size.

The device 1 further comprises a first fastening element 39 apt to keep in position the lower end 37*a* of the connecting element 37 inside the seat 36 of the air passage duct 34, and at least one second fastening element 40 apt to keep in position the upper end 37*b* of the connecting element 37 inside the air pipe 33.

In the preferred embodiment, the first fastening element 39 is a plate preferably provided with a plurality of openings 41 apt to house and fasten to body 35 a plurality of connecting elements 37, and the second fastening element 40 is a second plate apt to keep in position a plurality of connecting elements 37 inside a corresponding plurality of air pipes 33.

During mounting, the seal 38 is placed in the inlet seat 36 of the compressed air passage duct 34, then the lower end 37*a* of the connecting element 37 is snap fitted into the seal 38 and then the first fastening element 39 is positioned by inserting the connecting element 37 into a hole 41 of the first fastening element 39, which hole is provided with a relief 39*a* cooperating with a projection 37*c* of the connecting element or barbed fitting 37 for keeping it in position in contact with the body 35. Stated otherwise, the barbed fitting 37 is shaped so that the first fastening element 39 can push it downwards. The pressure exerted by the plate 39 forces the barbed fitting to get down and to interfere with the seal 38 blocking the latter inside the inlet seat 36 of the body 35 by means of the conical portion, creating a tightness also on the lower end 37*a* of the barbed fitting 37.

Now the compressed air pipe 33 is inserted into a hole 42 of the second fastening element 40, which is slid along the pipe for a certain length beyond the lower end of the compressed air pipe 33.

Then the conical upper end 37*b* of the connecting element 37 is snap fitted into the lower end of the corresponding air pipe 33, then the second fastening element 40 is slid on said lower end of the compressed air pipe 33 so that a protruding portion 43 of the conical upper end 37*b* of the connecting element 37 deforms the inner surface of the compressed air pipe 33, so that the forced coupling can ensure the tightness of the connection. Eventually, the second fastening element 40 is fastened to the first fastening element 39 so as to make it integral with the body 35 by way of at least one sealing element 44, which can be made up for instance of a screw or other suitable element.

It should be pointed out that the air seal 38 and the system described above according to the invention can be used so as to couple the various ducts obtained in the support element 3 with the various compressed air tubes, and therefore said system is used preferably on the large number of pneumatic connections between tubes and ducts that are present in the device 1 for supplying the various elements of the device 1 with compressed air.

The connection system described above ensures a high tightness of the pneumatic connection also with very small elements close to one another, without using traditional O-rings, which would not ensure a sufficient tightness in such a highly miniaturized application. The specific embodiment of the invention shown in the figures, and some preferred aspects thereof will now be described.

Each solenoid valve 23 is supplied with voltage and current by means of the dedicated electric supply system or electric bus 45 extending on the whole supporting element 3 or jacquard bar (for instance, the connection of the solenoid valves to the control device for the device 1 can be advantageously be carried out by using the same electric bus 45). Said bar 3 also houses the pneumatic supply system 28 or pneumatic supply bus, which is used by the solenoid valves 23 to fill with pressure P selectively through suitable ducts (pipes+ holes) the compartments of the cylinder body 16, so that the moving element 17 can shift in the pre-established direction and get out of the housing body 18. The counter-pressure pneumatic supply system 18*b* or counter-pressure pneumatic bus is made up of the ducts reaching each piston 17 in the lower portion of the housing body 18 so as to supply the necessary counter-pressure Pa (pneumatic spring) causing the piston 17 to get back into its case 18 when the solenoid valve is de-energized and air present in the ducts lying between the solenoid valve 23 and the piston 17 is evacuated (discharged) exactly by the effect of the pneumatic spring, which fills the second portion 19*b* of the sliding seat 19 causing the moving element 17 to be lifted up and the space previously occupied by pressurized air of the pneumatic supply bus to be emptied. Air is evacuated through the exhaust opening 27 of the solenoid valve 23. The two pneumatic buses operate at different pressure values, e.g. the supply bus at about P=0.55 MPa, the one of the pressure pneumatic spring at about Pa=0.35 MPa.

Advantageously, pressure level is adjusted so that the time spent by the piston for getting out of its case is the same as the time used for getting in, thus forming a balanced control system, since the time in which the thread-guide is shifted in one direction or the other must be the same.

It should be pointed out that the movement of the piston 17 actuates the actuating element or slider 12 equipped with the cam 13, which is apt to shift to the right or to the left the connected thread-guide as a result of the lifting or descending movement of the actuating element 12 depending on the position selectively taken by the piston 17.

The cam-shaped element 13 shifts the thread-guide 2 vigorously, since the piston 17 supplies in and out a force of about 350/400 grams (force values which are ten times higher than those of piezoceramic systems).

More to the point, the slider 12 can be shifted only in vertical direction, the horizontal movement (right or left)

thereof being prevented by the operating seat 14 in which it slides in the body 3, thus generating a very high horizontal force which prevents the thread-guide 2 from moving in that direction even to a very small extent. However high is the force exerted by the thread 7, the thread-guide 2 does not move to its position, it may happen that the thread 7 breaks but the slider 12 cannot move horizontally (if the thread is too strong, it may break the thread-guide). The detachment of the thread-guide 2 from the mechanical abutment due to the strong SHOG accelerations of the bar cannot occur since the slider, and therefore the thread-guide, cannot move horizontally.

These particular conditions (thread-guide secured to the abutment determined by the position of the cam contained in the slider) are unknown and cannot be though of for a piezoceramic system. Therefore, the invention offers the possibility to freely vary the horizontal shift of the thread-guides (higher stroke, adjustable also to very low finenesses such as 3, 4 or 5), since it is sufficient to use an adequate size for the system varying in particular the shape of the cam 13 (the inclination of the recess of the slider plate). Despite being bigger and heavier, the thread-guide 2 is however shifted by the piston 17, which can in its turn be bigger. Despite being thick and tightened, the thread 7 cannot shift horizontally the slider 12, but it can only break as was mentioned above, or break the thread-guide. For low finenesses (3, 4, 5), shifting speeds of current systems are far lower than higher finesses, whereas the invention enables to reach higher speeds also for low finenesses, even though obviously lower in case of low finenesses since the shift of the thread-guides 2 will be longer and piston strokes longer.

It should be pointed out that according to the invention the jacquard bars or devices 1 are independent and carry part of the machine intelligence in the form of drivers for the selective electronic actuation of the solenoid valves 23. Moreover, thanks to the device 1 according to the invention the function of the solenoid valves 23 can be tested.

The construction mode and operation of a suitable solenoid valve 23 will not be described in detail here since they are of per se known type, and since different sophisticated technologies can be used for said valve. The same applies also to the slider-holding piston and for the body housing it, which are of per se known type, although they are miniaturized as much as possible.

To the purposes of the present invention, it is sufficient to describe the use, outer size and arrangement thereof in the device 1.

For more clarity, the following contains a more detailed description of some aspects concerning the size and arrangement of the various parts in an embodiment by way of example on Raschel jacquard loom with double needle bed and fineness 24 (i.e. having on the needle bed 24 needles for every inch=25.4 mm). In this case the shed between one needle and the other is of 25.4:24=1.0583 mm.

For the operation of the jacquard device 1, each thread-guide 2 should be able to shift from its position (to the right or to the left) of a needle shed, and requires therefore sufficient space.

Therefore, the device or bar 1 designed for jacquard knitting should be doubled, thus there are two bars for each needle bed, one for even thread-guides 2 and one for odd thread-bars 2.

On the whole length of the needle bed, i.e. 45" (1,143 mm-1,080 needles) there will be two bars, each with a length of 45" (114,3 mm), but with a number of thread-guides 2 corresponding to half the needles of the needle bed, i.e. each jacquard bar will have 1,080:2=540 thread-guides. One bar will carry the thread-guides 2 working on even needles, the other one will work on odd needles, but each bar will enable its thread-guides 2 to shift of one needle to the right or to the left in the free space left by the thread-guide absent from its position. The thread-guide absent on the bar of even needles will obviously be present on the bar of odd needles.

It is thus possible, by means of the action of the jacquard device 1, to shift an even thread-guide 2 to the position of an odd needle, e.g. in cooperation with the SHOG movement, the even needle will not receive the thread assigned to it creating a hole in the fabric, the adjacent odd needle will receive two threads, one being the natural one and the other the one resulting from the needle shifting to odd position. Other combinations enable to obtain different knitting effects, such as holes, reinforcements, etc. These selective operations for shifting the thread-guides 2, together with SWING and SHOG movements of the machine, enable to obtain fabrics with very different knitted structures giving rise to a large number of patterns and effects on knitted fabrics. In the case of a Raschel machine with double needle bed, there will be globally four jacquard bars, each carrying 540 thread-guides (in case of 45"—fineness 24). Two bars will carry the thread-guides that normally form knitted fabric on the front needle bed, the other two will carry the thread-guides that normally form knitted fabric on the rear needle bed. It should be pointed out that said bars are radially spaced apart and carry the thread on the concerned needle at different times, since during the oscillating movement of the bars (swing) getting close to the raised needle, first acts one bar and then the following one without getting in each other's way.

When the fabric made on the front needle bed is seamed to the fabric made on the rear needle bed, so as to obtain a tubular fabric, thread-guides involved in this operation form knitted fabric also on the opposite needle bed, i.e. thread-guides on the front needle bed receiving a suitable order form knitted fabric not only on their needle bed but also on the rear needle bed, and conversely.

Now, after recalling the basic ideas underlying Raschel jacquard technique (prior art), some points should be pointed out referring in particular to FIG. 12B showing an example in which each pneumatic device 16 is made up of only one housing body or case 18 for each moving element 17.

Since with a fineness 24 the shed between one needle and the other is of 1.0583 mm, the shed between two even (or odd) thread-guides in jacquard bars will be of 1.0583×2=2.1166 mm.

In the example the pneumatic pistons 17 (or moving elements) have a diameter of 4 mm and are contained in a housing body or "case" 18 with a width of 5 mm. Therefore, said pistons 17 cannot be placed one beside the other as they would occupy a space of 10 mm, whereas the available space is of 2.1166 mm. Moreover, the sum of the various sheds (depending on fineness) does not result in finite numbers, but values with various tens of different numbers after point.

The length of an inch, 25.4 mm, divided by 4 (finite number) gives a shed of exactly 6.35 mm.

If the cases 18 of the pistons 17 are arranged aligned on one plane, they will overlap each other, but if they are arranged on different planes, they will not interact with each other as shown in the diagram of FIG. 12B. The space required for shifting three thread-guides is of 2.1166+2.1166+2.1166=6.35 mm.

If the cases are placed on three different places, the following cases can be placed on the same plane at a finite distance (6.35) from one another.

Since 6.35 mm is more than 5 mm (case width), therefore there is sufficient space between two following cases aligned on the same plane.

Moreover, 35.4:6.35=4, i.e. a finite number. The case A will control a first thread-guide, the case B the following one spaced of the shed of two needles, the cases C will control a third thread-guide spaced from the first one of 4.2333 mm, whereas the case A' will control a fourth thread-guide spaced from the first one of 6.35 mm.

It is thus possible to arrange a series of cases 18 containing control pistons 17 with a 2.1166 shed on three different levels, so that they do not interfere with each other. As can be seen in FIGS. 4, 7 and 8-8*b*, the thread-guides 2 will have as pivot one single point (on the mounting seat 2*a*), and as actuating portion 2*c* (or shifting area) three different positions on three different levels (for three following thread-guides 2). If we consider three cases A, B, C as a block, we can state that each block will be spaced apart of 6.35 mm.

It is thus possible to control each thread-guide 2 spaced of a double needle shed (2.1166) using an element whose size is almost three times as much as the shed itself, the whole in a vertical space corresponding to the space occupied by the bars with the thread-guides used for instance for pillar stitches on the same machine. Obviously, the arrangement of pneumatic device 16 according to the preferred embodiment, having cases for 5 moving elements (as in FIG. 12A) follows the same principles as described above.

Theoretically, with the same elements it is possible to achieve finenesses up to 28 by suitably modifying distances, whereas for higher finenesses it is necessary to add another level, i.e. 4 planes, and adequately size the whole, reaching fineness 32 with 4 planes.

Currently, such fineness does not exist in jacquard knitting and can hardly be achieved using the piezoceramic or "VERDOL" technology, since the needle shed is 25.4:32=0.79375; 0.79357×2=1.5875 mm, which is a very small distance for containing the space for a needle shift, the thickness of a thread-guide and mechanical abutments.

It should be remembered that fineness 32 is typical of circular knitting machines for women's tights, type 4"-401 needles ((4"×25.4×3.14)/401=0.796 mm needle shed in women's circular machines, very close to 0.79375 of a pure fineness 32 of a Raschel loom).

The following concerns the stop of the machine and of the device 1, both as a result of a voluntary switching-off and in case of unintentional switching-off (e.g. in case of blackout).

It should be pointed out that the actuating system according to the invention is of "MONOSTABLE" type with two positions. One position (the backward one) is stable when the solenoid valve 23 is de-energized (since the "pneumatic spring" always brings it back to the backward or default position). The other position (the forward one) is reached when the solenoid valve 23 is energized and it is kept until the electrical supply ends, which may happen as a result of an OFF control or of a blackout. The system is equipped with a suitable no-break power supply or standby battery, which is able to keep energized the solenoid valves 23 that were in ON status when the electrical supply was interrupted, so that the risk of a collision between thread-guide 2 and needle 6 when the machine is operating either SWING or SHOG movements is prevented. Therefore, the solenoid valve 23 is able to keep the single-effect pneumatic piston 17 constantly under pressure and in a pre-established position (through pneumatic counter-pressure or pneumatic spring) also in case of absence of electrical supply. The time for which the solenoid valve 23 is kept in ON status should be long enough so that the knitting machine undergoing the flywheel action of its moving elements stops completely in a predefined parking position.

The solenoid valves 23 can therefore control (by way of uninterruptible power supply or standby battery), thanks to their lower electrical power absorbance, the pneumatic piston 17 connected thereto, keeping the status achieved or changing the latter depending on the program. The machine is normally stopped in "ZERO" position at a pre-established angular value of the drive shaft, in which position all maintenance operations can be carried out easily and without interferences. "Zero" position is also the starting position of the control program for the machine.

When the electrical supply is restored (since the machine is stopped in "zero" position with thread-guides not interfering with needles), all solenoid valves 23 are brought back to the status provided for by the program in that specific turn of the drive shaft and at the angle in which the machine physically stopped, since said position is stored in a memory area of the control system dedicated to these cases. It should be pointed out that the problem concerning the possible sudden interruption of the electrical supply is also felt in the prior art.

As a matter of fact, piezoelectric or piezoceramic actuators (whose behaviour is of bistable type) keep the acquired position in case of power interruption and act as capacitors. However, the machine does not stop immediately and due to the flywheel effect due to its heavy transmission elements it goes on for a small space in its movement, so that the control system must record and store the whole machine status when the machine is actually still, so as to be able to resume work from the point where it stopped without damaging the fabric. With these systems the machine could stop without damage with the thread-guides placed between the needles, and if the stop is due to a thread break, it becomes sometimes quite impossible to repair and knot again the broken thread. It is therefore advisable to push the machine onward for a small space (using no-break power supply as described in the previous case) and park it in a position in which the operations involving the repair of the broken thread are simpler.

The use of energy for varying the position of the thread-guides according to the program during machine stop (movement step by flywheel effect) in case of use of piezoceramic actuators, can be compared to the energy used in the electropneumatic system.

In case of use of pull-and-push systems (Verdol®) the problem of a sudden power interruption makes things more difficult since elements are very robust and complex (large-size motors and solenoid valves are used), and it should anyhow be pointed out that also these systems are subject to the same problems described for piezoceramic and electropneumatic actuators of the present invention. The invention further relates also to a method for selectively shifting thread-guides 2 in a textile machine, comprising at least the step of supplying with compressed air the electropneumatic actuating devices 15, and in particular of supplying with such compressed air the plurality of electropneumatic valves 23 being part of the electropneumatic actuating devices 15, and therefore the plurality of pneumatic devices 16 having each at least one moving element 17 connected to a corresponding actuating element 12. The method further comprises the step of providing the electropneumatic actuating devices 15 and in particular the electropneumatic valves 23 with a jacquard movement program, so as to selectively shift by way of the electropneumatic actuating devices 15, supplied with compressed air, the actuating elements 12 in accordance with the jacquard movement program.

In particular, said step is carried out by selectively shifting, by way of the adjustment of the amount of compressed air supplied by the electropneumatic valves 23, the moving elements 17 between the forward and the backward position, in accordance with the jacquard movement program.

The method further comprises the step of moving by means of the actuating elements 12 the corresponding thread-guide portions 2*b* of the thread-guides 2, mounted in the housing seats 4 obtained on the supporting element 3, at least between the first and the second operating position.

The invention thus conceived can undergo several changes and variants, all of which fall within the scope of the inventive idea. In practice, any material and size can be used depending on the various needs. Moreover, all details can be replaced by other technically equivalent elements.

The invention achieves important advantages.

First of all, a jacquard device for selectively shifting thread-guides in a knitting machine according to the present invention can apply successfully to a very broad range of finenesses of a knitting machine. As a matter of fact, the invention ensures both a high force for keeping the thread-guides in the desired position also in case of relatively large shifts of the thread-guides (which is required for low finenesses) and a high compactness and speed in actuating the various parts and the thread-guides themselves (which is required for high finenesses). The device according to the present invention thus offers a high degree of operating safety also at high speeds and with several finenesses, avoiding the occurrence of phenomena of detachment and bouncing of the thread-guide from the corresponding abutment. Therefore, the device according to the invention is extremely accurate and reliable, reducing maintenance intervals and enabling to obtain finished products of very high quality. The invention further enables to improve the operating conditions for people working in the field, since the various parts of the machine are very robust and compact, minimizing maintenance operations and part replacement and providing spaces that are ergonomically sufficient for required interventions such as threading and maintenance operations. Moreover, the invention enables to prevent threads from interfering with thread-guide movement with a solution that is easy to carry out and to assemble, small in size and economical. It should further be pointed out that a device according to the invention has pneumatic connections ensuring high tightness conditions also for extremely miniaturized connections.

It should further be pointed out that a device according to the invention is very compact, simple to carry out and not very expensive both as far as construction and operation as well as maintenance are concerned.

The invention claimed is:

1. A jacquard device (1) for selectively shifting thread-guides (2) in a knitting machine, comprising:

at least one supporting element (3) provided with a plurality of housing seats (4) for a plurality of thread-guides (2), said supporting element (3) being a thread-guide bar of jacquard type for a warp linear knitting machine and being moving with respect to at least one bed (5) of needles (6) for selectively feeding the needles (6) of said bed (5) with a thread (7), a plurality of thread-guides (2) having each at least one mounting seat (2*a*) where they are fixedly mounted onto said supporting element (3), and at least one thread-guide portion (2*b*) selectively moving at least between a first and a second operating position and apt to guide said thread (7);

at least one actuating element (12) operatively acting upon at least one of said thread-guides (2) for shifting said thread-guide portion (2*b*) of said thread-guide (2) between said first operating position and at least said second operating position;

characterized in that it further comprises:

at least one electropneumatic actuating device (15) operatively connected to said actuating element (12) for shifting said actuating element (12) and thus said thread-guide portion (2*b*) of said thread-guide (2) between said first and said second operating position.

2. The device (1) according to claim 1, characterized in that said electropneumatic actuating device (15) comprises at least one pneumatic device (16) having a moving element (17) connected to said actuating element (12), which can be selectively shifted between a forward and a backward position, further comprising at least one electropneumatic valve (23) operatively connected to said pneumatic device (16) for selectively shifting said moving element (17) supplying said pneumatic device (16) with compressed air.

3. The device (1) according to claim 2, characterized in that said pneumatic device (16) comprises a housing body (18) containing at least one sliding seat (19) which houses in a movable way said moving element (17).

4. The device (1) according to claim 3, characterized in that said housing body (18) is provided on said sliding seat (19) with at least one main opening (20) apt to enable the passage of said moving element (17) or the connection of said moving element (17) to said actuating element (12).

5. The device (1) according to claim 4, characterized in that said housing body (18) is equipped on said sliding seat (19) with at least one air opening (21) and with at least one second air opening (22), said first opening (21) being apt to enable the introduction of compressed air (P) into a first portion (19*a*) of said sliding seat (19) so as to push said moving element (17) to said forward position, and said second opening (22) being apt to enable the introduction of compressed air (Pa) into a second portion (19*b*) of said sliding seat (19) so as to push said moving element (17) to said backward position.

6. The device (1) according to claim 5, characterized in that said moving element (17) is provided with at least one pushing portion (17*a*) on said second portion (19*b*) of said sliding seat (19) so as to enable compressed air (Pa) getting in from said second opening (22) to push the moving element (17) to said backward position.

7. The device (1) according to claim 3, characterized in that said housing body (18) is equipped with a plurality of sliding seats (19) for housing a plurality of moving elements (17).

8. The device (1) according to claim 2, characterized in that it further comprises a main pneumatic supply system (28*a*) apt to supply at least said electropneumatic valve (23) with inlet compressed air, said electropneumatic valve (23) being equipped with at least one valve body (24) for air communicating with the outside by way of an air inlet opening (25) operatively connected to said main pneumatic supply system (28), an air outlet opening (16) operatively connected to said pneumatic device (16) on said first opening (21), and a third air exhaust opening (27).

9. The device (1) according to claim 8, characterized in that it further comprises a counter-pressure pneumatic supply system (28*b*) operatively connected to said pneumatic device (16) on said second opening (22) so as to enable the introduction of compressed air (Pa) into said second portions (19*b*) of said seat (19) and to push said moving element (17) to said backward position when said electropneumatic valve (23) is able to evacuate air, said counter-pressure pneumatic supply system (28*a*) further comprising a pressure reducer (29) operatively arranged upstream from said second opening (22) of said pneumatic device (16).

10. The device (1) according to claim 1, characterized in that it further comprises at least one control device (47) operatively connected to at least one of said electropneumatic valves (23) so as to control the movement of said thread-guide portion (2*b*) of said thread-guide (2) in accordance with a pre-established working jacquard program.

11. The device (1) according to claim 2, characterized in that it further comprises an engagement element (11) associated to an actuating portion (2*c*) of said thread-guide (2), and in that said actuating element (12) is provided with a cam-shaped element (13) cooperating with said engagement element (11) so as to convert the movement of said actuating element (12) into a predefined movement of said actuating portion of said thread-guide (2) and thus of said thread-guide portion (2*b*) of said thread-guide (2).

12. The device (1) according to claim 1, characterized in that it comprises a plurality of said actuating elements (12) each associated to a corresponding plurality of said thread-guides (2)and a plurality of said electropneumatic actuating devices (15) each operatively connected to one of said actuating elements (12).

13. The device (1) according to claim 12, characterized in that said plurality of said actuating elements (12) is arranged spaced apart on at least two rows at different heights, so that the actuating devices (12) connected to adjacent thread-guides (2) are arranged on different rows.

14. The device (1) according to claim 13, characterized in that said plurality of moving elements (17) of said pneumatic devices (16) is arranged spaced apart on at least two rows at different heights, so that the moving elements (17) connected to adjacent thread-guides by way of suitable actuating devices (12) are arranged on different rows.

15. The device (1) according to claim 1, characterized in that each housing seat (4) of the supporting element (3) is provided with side end-of-stroke portions (10) apt to determine said first and said second operating position of the thread-guide portion (2*b*) of the thread-guide (2), and in that it further comprises at least one covering element (30) apt to cover at least one portion of said housing seats (4) of the supporting element (3) so as to support said thread (7) and prevent the latter from getting into the housing seats (4) and interfering with the movement of the thread-guide portions (2*b*) of the thread-guides (2).

16. The device (1) according to claim 15, characterized in that said covering element (30) is mounted on said supporting element (3) close to said side end-of-stroke portions (10) so as to cover a plurality of housing seats (4) of said thread-guides (2).

17. The device (1) according to claim 15, characterized in that said covering element (30) is fitted onto corresponding engagement seats (31) made on said supporting element (3).

18. The device (1) according to claim 15, characterized in that it further comprises an additional supporting element (32) for the thread (7), arranged upstream from said covering element (30) with respect to a feeding path of said thread (7).

19. The device (1) according to claim 1, characterized in that it comprises at least one air pipe (33), at least one air passage duct (34) obtained in a body (35) and provided with an inlet seat (36), at least one connecting element (37) hollow inside and provided with two ends (37*a*, 37*b*) having an outer surface that is at least partially conical and apt to connect said air pipe (33) to said passage duct (34), and at least one seal (38) apt to be inserted into said air inlet seat (36) and having an inner surface that is at least partially conical and apt to fit into a first one (37*a*) of said ends of said connecting element (37).

20. The device (1) according to claim 19, characterized in that it further comprises a first fastening element (39) apt to keep in position said first end (37*a*) of said connecting element (37) inside said inlet seat (36) of said air passage duct (34).

21. The device (1) according to claim 19, characterized in that it further comprises a second fastening element (40) apt to keep in position said second end (37*b*) of said connecting element (37) inside said air pipe (33).

22. The device (1) according to claim 21, characterized in that said first fastening element (39) is a plate provided with a plurality of openings (41) apt to house and to fasten to said body (35) a plurality of said connecting elements (37), and in that said second fastening element (40) is a second plate provided with a plurality of openings (42) apt to keep in position said plurality of connecting elements (37) inside a corresponding plurality of said air pipes (33), said second fastening element (40) being associated to said first fastening element (39) so as to make it integral with said body (35) by means of at least one sealing element (44).

23. A warp linear textile machine, characterized in that it comprises at least one jacquard device (1) for selectively shifting thread-guides (2) in accordance with claim 1.

24. The machine according to claim 23, characterized in that it comprises at least one bed (5) of needles (6) and at least two of said devices (1) on each needle bed (5, 5*a*).

25. The machine according to claim 23, characterized in that it further comprises a control device operatively connected to said control device of said jacquard device (1).

26. A method for selectively shifting thread-guides in a textile machine, comprising at least the following steps:

supplying a plurality of electropneumatic actuating devices (15) with pressurized air;

providing said plurality of electropneumatic actuating devices (15) with a jacquard movement program;

selectively shifting by way of said electropneumatic actuating devices (15) supplied with pressurized air a plurality of actuating elements (12) in accordance with said jacquard movement program; and shifting by way of said plurality of actuating elements (12) a corresponding plurality of thread-guide portions (2*b*) of thread-guides (2), mounted in dedicated housing seats (4) obtained on a supporting element (3), at least between a first and a second operating position.

27. The method according to claim 26, characterized in that it further comprises the following steps:

supplying with said compressed air a plurality of electropneumatic valves (23) being part of said electropneumatic actuating devices (15) and a plurality of pneumatic devices (16) each having at least one moving element (17) connected to one of said actuating elements (12);

controlling by means of said jacquard movement program the operating of said plurality of electropneumatic valves (23); and selectively shifting, by adjusting compressed air supplied by said electropneumatic valves (23), said actuating elements (12) between a forward and a backward position, in accordance with said jacquard movement program.

* * * * *